United States Patent [19]

Bando

[11] Patent Number: 4,922,293

[45] Date of Patent: May 1, 1990

[54] CONTROL SYSTEM FOR AN IMAGE FORMING APPARATUS

[75] Inventor: Toshiro Bando, Yokohama, Japan

[73] Assignee: Ricoh Company, Ltd., Tokyo, Japan

[21] Appl. No.: 266,170

[22] Filed: Nov. 2, 1988

[30] Foreign Application Priority Data

Nov. 4, 1987 [JP] Japan ..... 62-278594

[51] Int. Cl.[5] ..... G03G 15/00

[52] U.S. Cl. ..... 355/200; 364/131

[58] Field of Search ..... 355/200, 216, 202–209, 355/313; 364/131–134, 136, 200 MS File, 900 MS File, 525

[56] References Cited

U.S. PATENT DOCUMENTS 4,166,690 9/1979 Bacon et al. ..... 355/216 X
4,556,310 12/1985 Masuda ..... 355/202
4,755,996 7/1988 Masuda ..... 364/525 X

*Primary Examiner*—Joan H. Pendegrass
*Attorney, Agent, or Firm*—Oblon, Spivak, McClelland, Maier & Neustadt

[57] ABSTRACT

A control system for a copier, printer, facsimile apparatus or similar image forming apparatus which uses electrophotography controls, by digital control and by using a single signal line, a respective one of various control units for implementing image forming processes such as a grid power source for a main charger, a bias power source for development, a transfer charger power source, an exposing lamp regulator, and a fixing roller temperature controller.

2 Claims, 37 Drawing Sheets

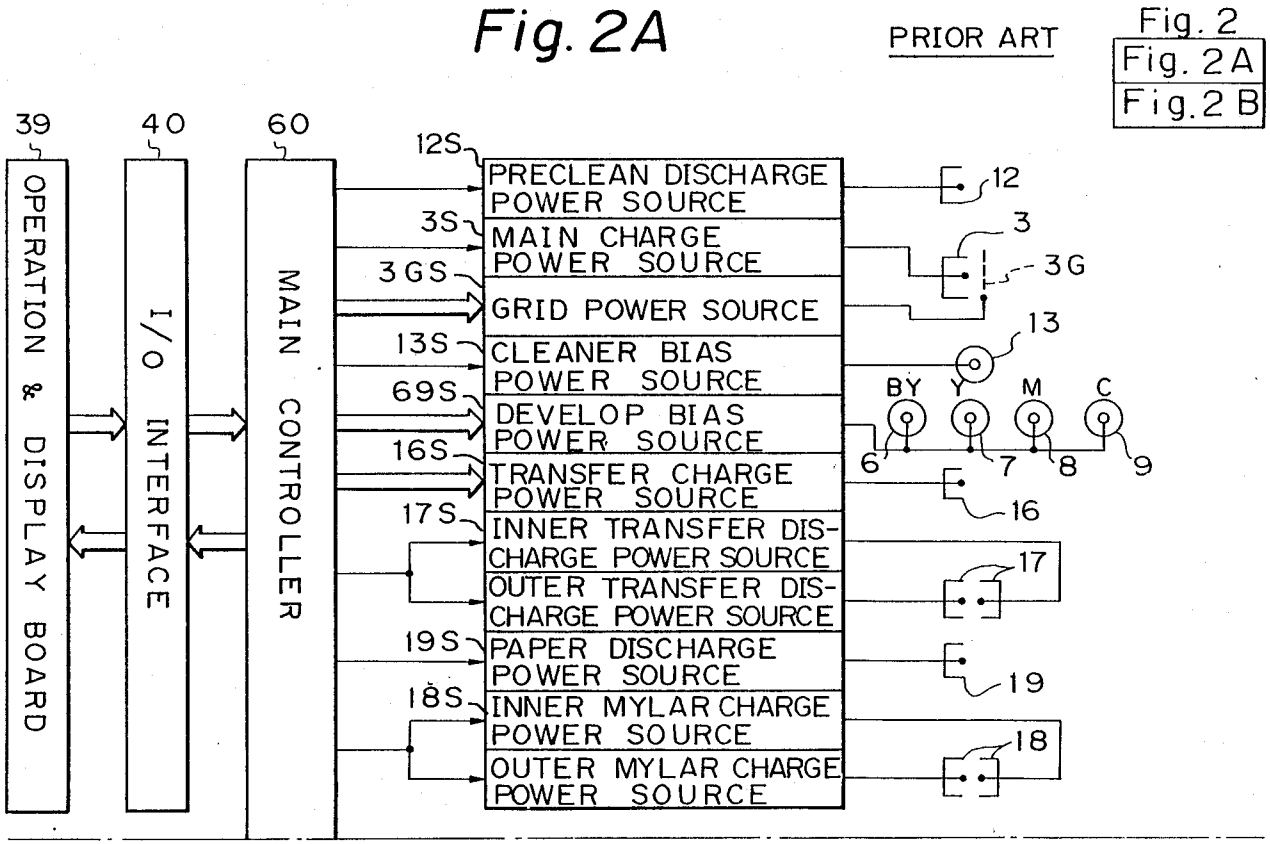
Fig. 2
Fig. 2A
Fig. 2B
PRIOR ART
Fig. 2A
PRECLEAN DISCHARGE POWER SOURCE
MAIN CHARGE POWER SOURCE
GRID POWER SOURCE
CLEANER BIAS POWER SOURCE
DEVELOP BIAS POWER SOURCE
TRANSFER CHARGE POWER SOURCE
INNER TRANSFER DIS-CHARGE POWER SOURCE
OUTER TRANSFER DIS-CHARGE POWER SOURCE
PAPER DISCHARGE POWER SOURCE
INNER MYLAR CHARGE POWER SOURCE
OUTER MYLAR CHARGE POWER SOURCE
12S
3S
3GS
13S
69S
16S
17S
19S
18S
12
3
3G
13
BY
Y
M
C
6
7
8
9
16
17
19
18
60
MAIN CONTROLLER
40
I/O INTERFACE
39
OPERATION & DISPLAY BOARD

| | |
|---|---|
| Fig. 4 A | Fig. 4 B |
| Fig. 4 C | Fig. 4 D |

EXPOS LAMP 4
ZERO-CROSS (50/60Hz)
FIX HEATER 22
GRID DRIVE 3
BIAS DRIVE 6~9
INT1
INTTØ
INV
INV
TM1
A/D
INT1
TMØ
A/D
(48.0μs)
EXT TM2
A/D
PWM PERIOD(50μs)
EXT TM1
A/D
SAMPLE (8.3/10ms)
(32.0μs×n)
(32.0μs×n)
(0.125μs×n)
EXT TMØ
(0.125μs×n)
71C
EXPOS LAMP CONTROL (P)
FIX HEATER CONTROL (PI)
GRID CONTROL (PI)
BIAS CONTROL (PI)
SAMPLE INTERVAL (67/80ms)
SAMPLE INTERVAL(5ms)
SAMPLE INTERVAL (5ms)
DIV
DIV
71A
71B
71D
RxD
(31.25bps)
TxD
COMMUNI-CATION (INTSR)
DIV

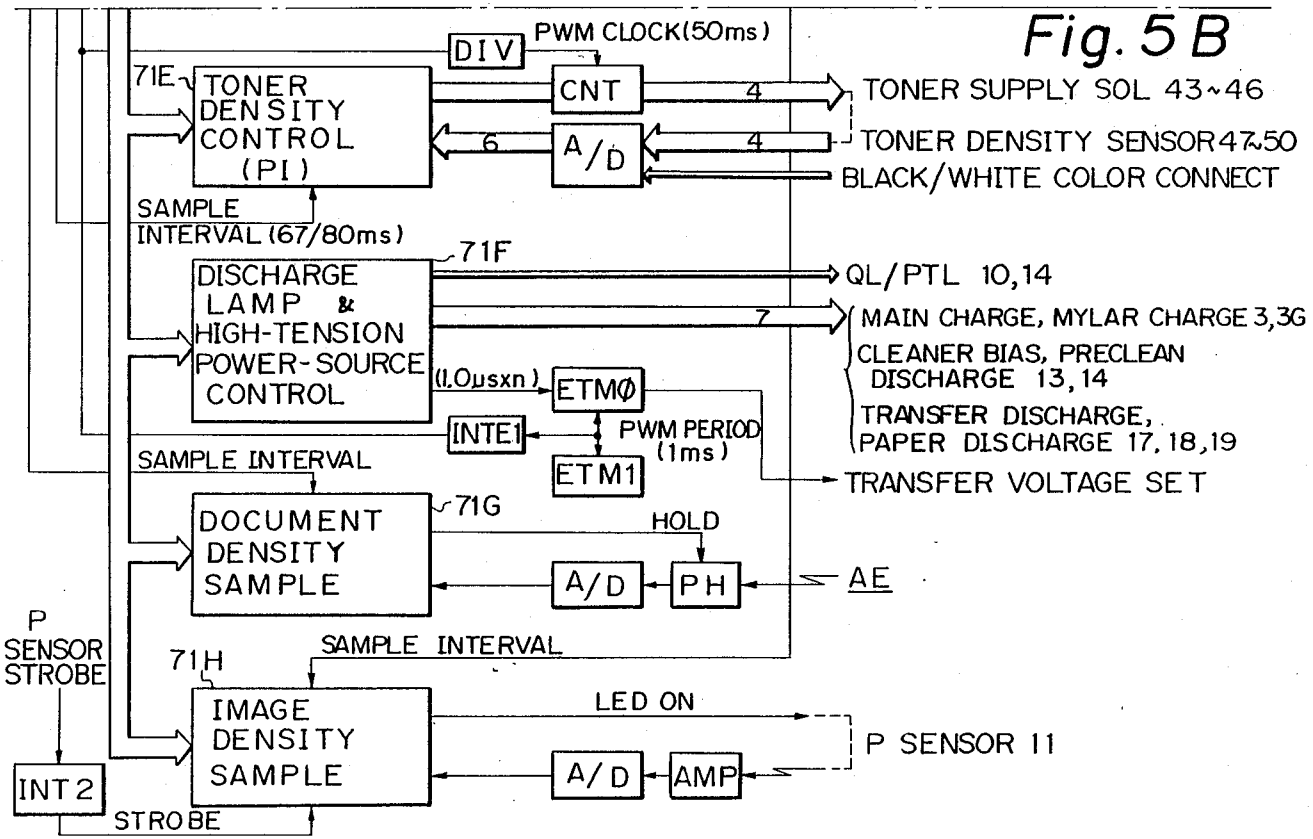
Fig. 5B
TONER SUPPLY SOL 43~46
TONER DENSITY SENSOR 47~50
BLACK/WHITE COLOR CONNECT
QL/PTL 10,14
MAIN CHARGE, MYLAR CHARGE 3,3G
CLEANER BIAS, PRECLEAN DISCHARGE 13,14
TRANSFER DISCHARGE, PAPER DISCHARGE 17,18,19
TRANSFER VOLTAGE SET
AE
P SENSOR 11
PWM CLOCK(50ms)
DIV
CNT
A/D
4
4
6
7
71F
71E
TONER DENSITY CONTROL (PI)
SAMPLE INTERVAL (67/80ms)
DISCHARGE LAMP & HIGH-TENSION POWER-SOURCE CONTROL
(1.0μsxn)
ETMØ
PWM PERIOD (1ms)
ETM1
INTE1
SAMPLE INTERVAL
71G
DOCUMENT DENSITY SAMPLE
HOLD
PH
A/D
SAMPLE INTERVAL
LED ON
71H
IMAGE DENSITY SAMPLE
A/D
AMP
STROBE
P SENSOR STROBE
INT 2

| |
|---|
| Fig.25A |
| Fig.25B |

Fig. 29
Fig. 29A
Fig. 29B

Fig. 29A

RAM MAP

| | |
|---|---|
| HIGH-TENSION OUTPUT 0 | |
| HIGH-TENSION OUTPUT 1 | |
| HIGH-TENSION OUTPUT 2 | |
| SET Y TONER DENSITY | |
| SET M TONER DENSITY | |
| SET C TONER DENSITY | |
| SET BL TONER DENSITY | |
| SET LAMP VOLTAGE | |
| SET GRID VOLTAGE | |
| SET BIAS VOLTAGE | |
| SET TRANSFER VOLTAGE | |
| SET FIXING TEMPERATURE | |
| ADDRESS RECEIVE FLAG | RECEIVE BUFFER |
| SYNC CHARACTER | |
| CONTROL STATUS | |
| SENSED FIX TEMP | |
| SENSED PATTERN DENSITY | |
| SENSED DOCUMENT DENSITY | |
| SENSED Y TONER DENSITY | |
| SENSED M TONER DENSITY | |
| SENSED C TONER DENSITY | |
| SENSED BL TONER DENSITY | |
| TRANSMIT ADDRESS COUNTER | TRANSMIT BUFFER |
| FREQUENCY DETECTED FLAG | FREQUENCY DETECT |
| 60 Hz FLAG | |
| ... | |

| | |
|---|---|
| BIAS VOLTAGE SAMPLING FLAG | BIAS CONTROL |
| DETECTED BIAS VOLTAGE 1 | |
| DETECTED BIAS VOLTAGE 2 | |
| TARGET BIAS VOLTAGE | |
| PWM PULSE WIDTH | |
| PROPORTION GAIN | |
| INTEGRATION GAIN | |
| TONER CONTROL START FLAG | TONER DENSITY CONTROL |
| TONER SUPPLY SOL PERIOD COUNTER | |
| SENSED BL TONER 1 | |
| SENSED BL TONER 2 | |
| TARGET BL TONER | |
| BL TONER SUPPLY SOL PWM COUNTER | |
| BL TONER PROPORTION GAIN | |
| BL TONER INTEGRATION GAIN | |
| SENSED Y TONER 1 | |
| SENSED Y TONER 2 | |
| TARGET Y TONER | |
| Y TONER SUPPLY SOL PWM COUNTER | |
| Y TONER PROPORTION GAIN | |
| Y TONER INTEGRATION GAIN | |
| SENSED M TONER 1 | |
| SENSED M TONER 2 | |
| TARGET M TONER | |
| M TONER SUPPLY SOL PWM COUNTER | |
| M TONER PROPORTION GAIN | |
| M TONER INTEGRATION GAIN | |
| SENSED C TONER 1 | |
| SENSED C TONER 2 | |
| ... | |

Fig. 29B

| | |
|---|---|
| LAMP CONTROL | LAMP VOLTAGE SAMPLING FLAG |
| | SOFT START FLAG |
| | INCREMENT OF SOFT START |
| | DETECTED LAMP VOLTAGE |
| | EFFECTIVE LAMP VOLTAGE |
| | TARGET LAMP VOLTAGE |
| | LAMP PHASE ANGLE |
| | PROPORTION GAIN |
| | SAFETY TIMER |
| | LAMP ON VOLTAGE THRESHOLD |
| HEATER CONTROL | FIX TEMP SAMPLING FLAG |
| | SENSED FIX TEMP 1 |
| | SENSED FIX TEMP 2 |
| | TARGET FIX TEMP |
| | HEATER PHASE ANGLE |
| | PROPORTION GAIN |
| | INTEGRATION GAIN |
| | OVERHEAT THRESHOLD |
| | THERMISTER DOWN THRESHOLD |
| | PRELOAD THRESHOLD |
| GRID CONTROL | GRID VOLTAGE SAMPLING FLAG |
| | DETECTED GRID VOLTAGE 1 |
| | DETECTED GRID VOLTAGE 2 |
| | TARGET GRID VOLTAGE |
| | PWM TIMER PULSE WIDTH |
| | PROPORTION GAIN |
| | INTEGRATION |
| | SAMPLING TIMER (5MSEC) |

| | |
|---|---|
| P SENSOR DATA PROCESSING | TARGET C TONER |
| | C TONER SUPPLY SOL PWM COUNTER |
| | C TONER PROPORTION GAIN |
| | C TONER INTEGRATION GAIN |
| | PWM COUNTER CLOCK (50 MSEC) |
| | PATTERN DENSITY SAMPLING FLAG |
| | LAST ADDRESS STORED FLAG |
| | WHITE PORTION DENSITY 0 (Vsg 0) |
| | WHITE PORTION DENSITY 1 (Vsg 1) |
| | ~ |
| | WHITE PORTION DENSITY 7 (Vsg 7) |
| | UPPER BITS OF Vsg LAST ADDRESS |
| | LOWER BITS OF Vsg LAST ADDRESS |
| | WHITE PORTION AVERAGE DENSITY(MVsg) |
| | BLACK PORTION DENSITY 0 (Vsp 0) |
| | BLACK PORTION DENSITY 1 (Vsp 1) |
| | ~ |
| | BLACK PORTION DENSITY 7 (Vsp 7) |
| | BLACK PORTION AVERAGE DENSITY(MVsp) |
| | BLACK/WHITE DENSITY RATIO(MVsp/MVsg) |
| DOCUMENT DENSITY SENSING | AE STROBE COUNTER |
| | OPERATION TIMER DECIDE FLAG |
| | TARGET VALUE (S) |
| | SENSED VALUE 1 (Vo) |
| | SENSED VALUE 2 (V1) |
| | VARIATION OF OPERATION AMOUNT (ME) |
| PROPORTION INTEGRATION | OPERATION AMOUNT (M) |
| | PROPORTION GAIN (KP) |
| | INTEGRATION GAIN |

CONTROL SYSTEM FOR AN IMAGE FORMING APPARATUS

BACKGROUND OF THE INVENTION

The present invention relates to a control system for a copier, printer, facsimile apparatus or similar image forming apparatus which uses electrophotographic processes.

An electrophotographic copier, for example, performs a sequence of image forming processes, i.e., charging process, exposing process, developing process, transferring process and fixing process, as well known in the art. An exclusive control unit is customarily assigned to each of such image forming processes (e.g. a high tension power source for a charging and transferring process, a lamp regulator for an exposing process, a bias voltage source for a developing process, and a temperature controller for a fixing process). To make the condition of any of the processes variable or adjustable, it has been necessary to apply to the control unit associated with the process a digital signal having bits the number of which matches with the variable range of condition (e.g. four bits for less than sixteen steps or five bits for less than thirty-two steps) or an analog signal produced by converting the digital signal. For example, in the case that a 5-bit digital signal is applied to each of the control units assigned to the charging, exposing, developing, transferring and fixing processes, twenty-five parallel signal lines (twenty-five bits) are required. Especially, a color copier which involves complicated image forming conditions has a variable range which amounts to more than sixteen steps (six bits) and therefore needs more than thirty signal lines. This is disadvantageous not only from the actual mounting standpoint (wiring and spacing) but also from the cost standpoint.

Some modern control systems designed to digitally control a color copier are implemented by a main controller in the form of a microprocessor. The main controller controls various control units which are built in a color copier, i.e., a grid power source for applying a grid voltage to the grid of a main charger, a bias voltage source for applying a bias voltage to a developing sleeve, a power source for applying a transfer charge current to a transfer charger, a lamp regulator for adjusting the voltage applied to a lamp for exposure, and a temperature controller for controlling the fixing temperature of a fixing roller. Since the voltage, current and temperature governed by these control units are variable over several tens of levels and not constant, the main controller usually feeds signals of more than five bits (thirty-two steps) to the individual control units. The result is the prohibitive number of signal lines and connectors which increase the cost and lowers the reliability of operation. Another problem with such a scheme is that the main controller has to supervise a paper feed section, paper transport section, operation section and other various sections as well and, hence, the control program is prohibitively scaled up to bring about bugs and slow execution. When all of the grid power source, transfer charge power source, lamp regulator and temperature controller are implemented by an analog control principle, they become susceptible to noise and their outputs are difficult to control in a variable fashion. Thus, the dilemmatic situation is that a digital control system is not achievable without installing at least thirty signal lines for digital data alone while an analog control system, although needing only one signal line for each control unit, is susceptible to noise. Furthermore, the various control units stated above are traditionally controlled by an analog system and, therefore, cannot adapt themselves to various kinds of loads (specifications, power, input/output characteristics, etc.). Even the controller itself is not operable when the control units are replaced.

SUMMARY OF THE INVENTION

It is therefore an object of the present invention to provide a control system for an image forming apparatus which allows various image forming conditions to be set with ease.

It is another object of the present invention to provide a control system for an image forming apparatus which reduces the number of signal lines associated with individual control units for image forming.

It is another object of the present invention to provide a control system for an image forming apparatus which enhances resistivity to noise.

It is another object of the present invention to provide a control system for an image forming apparatus which is simple, uncostly and feasible for a wide variety of applications.

It is another object of the present invention to provide a generally improved control system for an image forming apparatus.

A control system for an image forming apparatus of the present invention is of the type energizing in a predetermined sequence control units for image forming including a main charger for charging a surface of a photoconductive element, an exposing light source for exposing the charged surface of the photoconductive element to imagewise light, a developing device for developing an electrostatic latent image formed on the charged surface of the photoconductive element by toner, and a transfer charger for transferring a toner image to a recording medium, reading at predetermined timings output signals of sensors including a current-/voltage sensor responsive to voltages/currents of the control units, a document image density sensor, and a developed image density sensor responsive to toner density in a predetermined area on the drum outside of a recording medium transfer area, and adjusting the voltages or currents of the control units in response to the output signals of the sensors. The system comprises a main control unit for producing signals for commanding energization/deenergization of the control units in a predetermined sequence, producing digital signals representative of target values for engergizing the control units, and transmitting the signals for commanding energization/deenergization and digital signals representative of the target values, and a process control unit for receiving the signals commanding energization/-deenergization which are sent from the main control unit and energizing/deenergizing the control units based on the signals, receiving the digital signals representative of the target values from the main control unit, converting the output signals of the sensors, and setting voltages/currents for energizing the control units on the basis of the digital signals representative of the target values and the digital signals associated with the output signals of the sensors.

BRIEF DESCRIPTION OF THE DRAWINGS

The above and other objects, features and advantages of the present invention will become more apparent from the following detailed description taken with the accompanying drawings in which:

FIG. 29, which consist of 29A and 29B, shows data which are written in a random access memory (RAM) which is built in the microprocessor.

DETAILED DESCRIPTION OF THE PREFERRED EMBODIMENT

Figure 1:
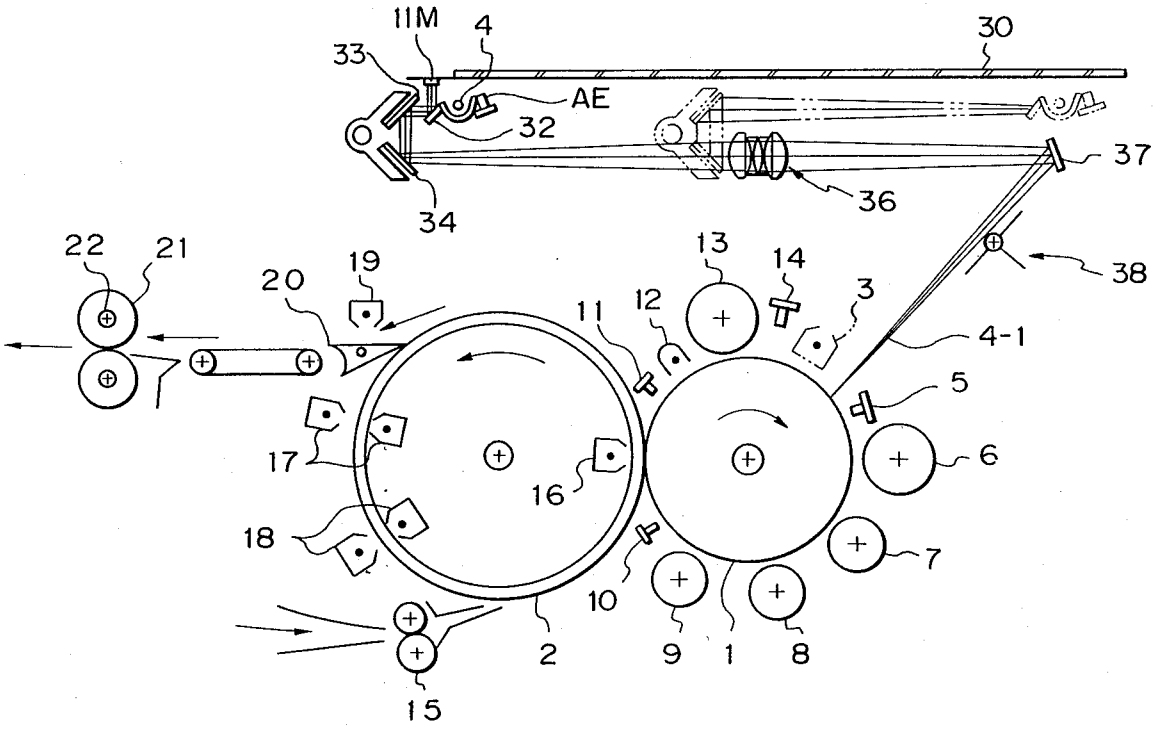
FIG. 1 is a side elevation showing the arrangement of various units of a color copier which join in an image forming operation and to which the present invention is applicable.

To better understand the present invention, a brief reference will be made to a color copier representative of a family of image forming apparatuses to which the present invention is applicable, shown in FIG. 1. In the figure, a photoconductive element 1 in the form of a drum, for example, is charged by a main charger 3. An original document laid on a glass platen 30 is illuminated by a lamp 4 and the resulting reflection is routed through a first mirror 32, a second mirror 33, a third mirror 34, a lens unit 36, a fourth mirror 37 and a color filter 38 to the charged surface of the drum 1. As a result, a latent image associated with the document is electrostatically formed on the drum 1. An eraser discharges a part of the drum 1 which surrounds a latent image area corresponding to the size of a paper. In a black (BL) copy mode, the latent image is developed by a black developing sleeve 6 of a developing device to become a toner image. The toner image is illuminated by a pretransfer discharge lamp 10 and, at a position where a transfer charger 16 is located, transferred to a paper which is retained on a transfer drum 2. The paper carrying the toner image thereon is separated from the drum 2 by a pawl 20 at a position where a discharging charger, or discharger, 19 is located and then driven toward a fixing unit which is constituted by a fixing roller 21 and a fixing heater 22.

Afterwards, the surface of the drum 1 is discharged by a precleaning discharger 12, then cleaned by a cleaning sleeve 13, and then discharged by a discharging lamp 14. The transfer drum 2 is charged by a Mylar charger 18 before a paper is applied thereto so that a paper fed from a register roller 15 may adhere to the drum 2. After the separation of the paper, the surface of the transfer drum 2 is discharged by a discharger 17. In a color copy mode, the latent image is developed by a yellow developing sleeve 9, then discharged by the pretransfer discharge lamp 10 for removing the remaining charge of the toner image, and then transferred to a paper which is fed from the register roller 15 and wrapped around the transfer drum 2. Subsequently, the drum 1 is charged by the precleaning discharger 12 to neutralize the charge of the toner image remaining thereon and then illuminated by the discharge lamp 14 to fully remove the remaining charge. The sequence of steps from the main charging to the discharging are repeated with magenta and cyan to reproduce a full-color image on the paper. Again, this paper is separated from the transfer drum 2 by the pawl 20 and discharger 19 and transported to the fixing unit. It is to be noted that in the event of exposure/development in each color a filter associated with the color is brought into an optical path for exposure. In the figure, the reference numerals 5, 7, 8 and 11 designate the eraser, a cyan developing sleeve, a magenta developing sleeve, and a P sensor. Labeled 11M is a solid mark.

Figure 2B:
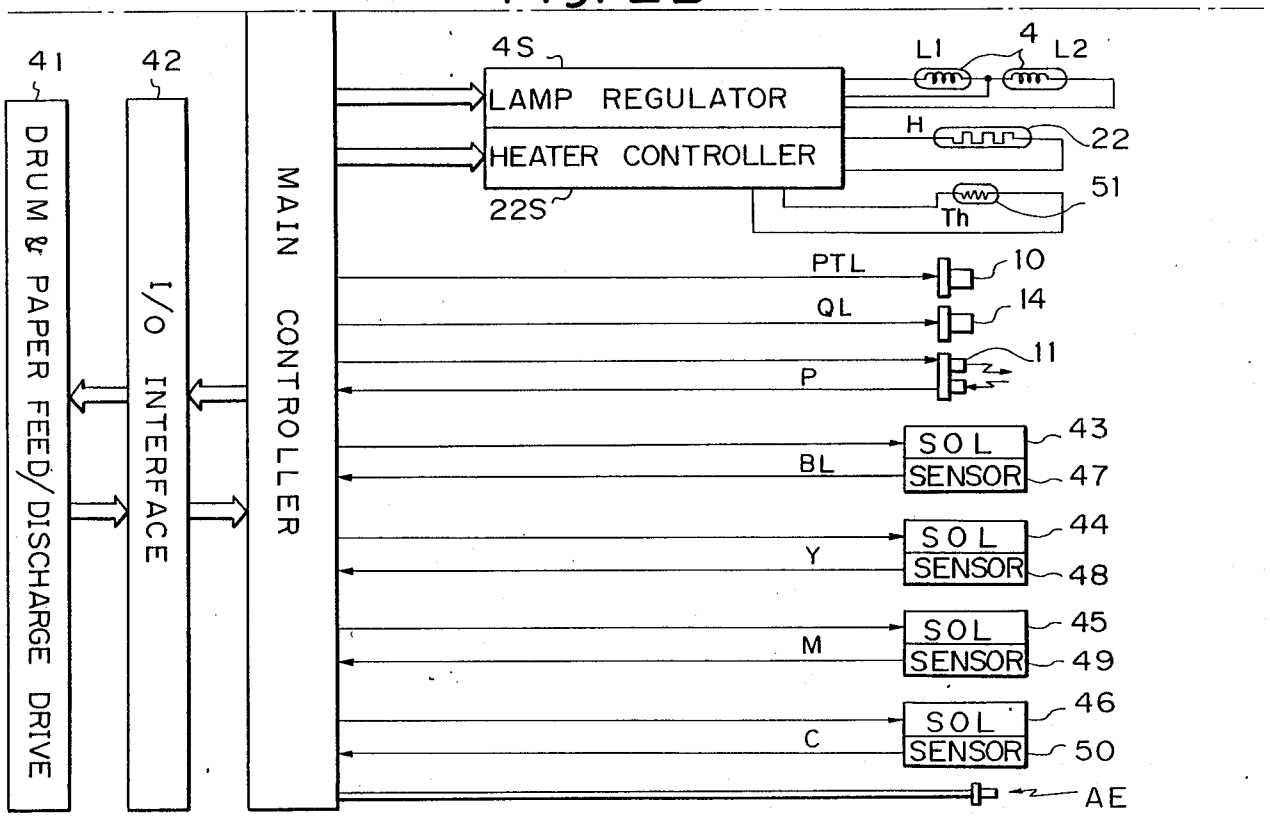
FIG. 2, which consist of FIG. 2A, 2B is a schematic block diagram outlining a prior art digital control system which may be installed in a color copier of FIG. 1.

Referring to FIG. 2, a specific construction of a prior art digital control system applicable to the color copier discussed above is shown. The system includes a main controller 60 which is mainly constituted by a microprocessor system and adapted to set a desired copy mode (single color, two color or three color), a number of copies to be produced, image density, tone and the like in response to the manipulation of an operation and display board 39 while delivering signals representative such data to various processing units for image forming. When a print key of the copier is pressed, the main controller 60 generates a sequence signal for commanding each unit energization/deenergization and controls the setting of the color filter 38 as well as the drive of drums and paper feed and discharge mechanisms. The main controller 60 feeds only an ON (energize)/OFF (deenergize) signal to a precleaning discharge power source 12S adapted to apply a charge voltage to the discharger 12, feeds a charger voltage ON/OFF signal to a main charger power source 3S associated with the main charger 3, feeds digital data (six bits) to a grid power source 3GS associated with a grid 3G of the main charger 3 for specifying an amount of charge, feeds digital data (six bits) to a developing bias voltage source 69S for specifying a bias voltage, feeds an ON/-OFF signal to each of discharge power sources 17S and 19S, feeds an ON/OFF signal to a charger power source 18S, feeds digital data (six bits) to a lamp regulator 4S for specifying an amount of light, and feeds digital data (six bits) to a heating element controller 22S for specifying fixing power. Further, the main controller 60 applies energizing voltages to the discharge lamps 10 and 14 and applies a voltage to the P sensor 11 while receiving an output of the P sensor 11. Also connected to the main controller 60 are a black (BL) toner supply solenoid 43, a BL toner density sensor 47, a yellow (Y)

toner supply solenoid 44, a Y toner density sensor 48, a magenta (M) toner supply solenoid 45, an M toner density sensor 49, a cyan (C) toner supply solenoid 46, a C toner density sensor 50, and a document image density sensor AE. The P sensor 11 plays the role to sense the density of a solid pattern image which is formed outside of the effective image area (e.g. toner image of the solid mark 11M shown in FIG. 1). In FIG. 2, the reference numerals 40 and 42 designate input/output (I/O) interfaces while 41 designates a drive system.

Since the copying processes performed by a color copier are complicated, the grid voltage applied to the grid 3G of the main charger 3, the bias voltage applied to the developing sleeves 6 to 9, the charge current applied to the transfer charger 16, the voltage applied to the lamp 4, and the fixing temperature of the fixing roller 21 have to be individually variable over several tens of levels, as stated earlier. To meet this requirement, it has been customary to cause the main controller 60 to deliver a signal having more than five bits (thirty-two steps) to each of the control units 3GS, 69S, 16S, 4S and 22S, resulting in the prohibitive number of signal lines and connectors, high cost, and poor reliability. Further, the main controller 60 also controls other operative sections of the copier such as a paper feed section, paper transport section and an operating section and, therefore, the control program is extremely scaled up to bring about bugs and slow execution. When all of the grid power source 3GS and transfer charge voltage source 16S which are high-tension power sources, lamp regulator 4S and heater controller 22S are controlled by an analog system, they are susceptible to noise and it is difficult to control their outputs variably. Thus, a digital control system increases the number of signal lines to thirty for digital data alone while an analog control system is susceptible to noise although reducing the number of signal lines to each unit to one. Moreover, each control unit (3GS, 69S, 16S, 4S or 22S) is conventionally controlled by an analog system and therefore cannot adapt itself to a different kind of load (specification, power, input/output characteristics, etc.). Even the controller or microprocessor itself is not operable when the control units are replaced.

Figure 3A:
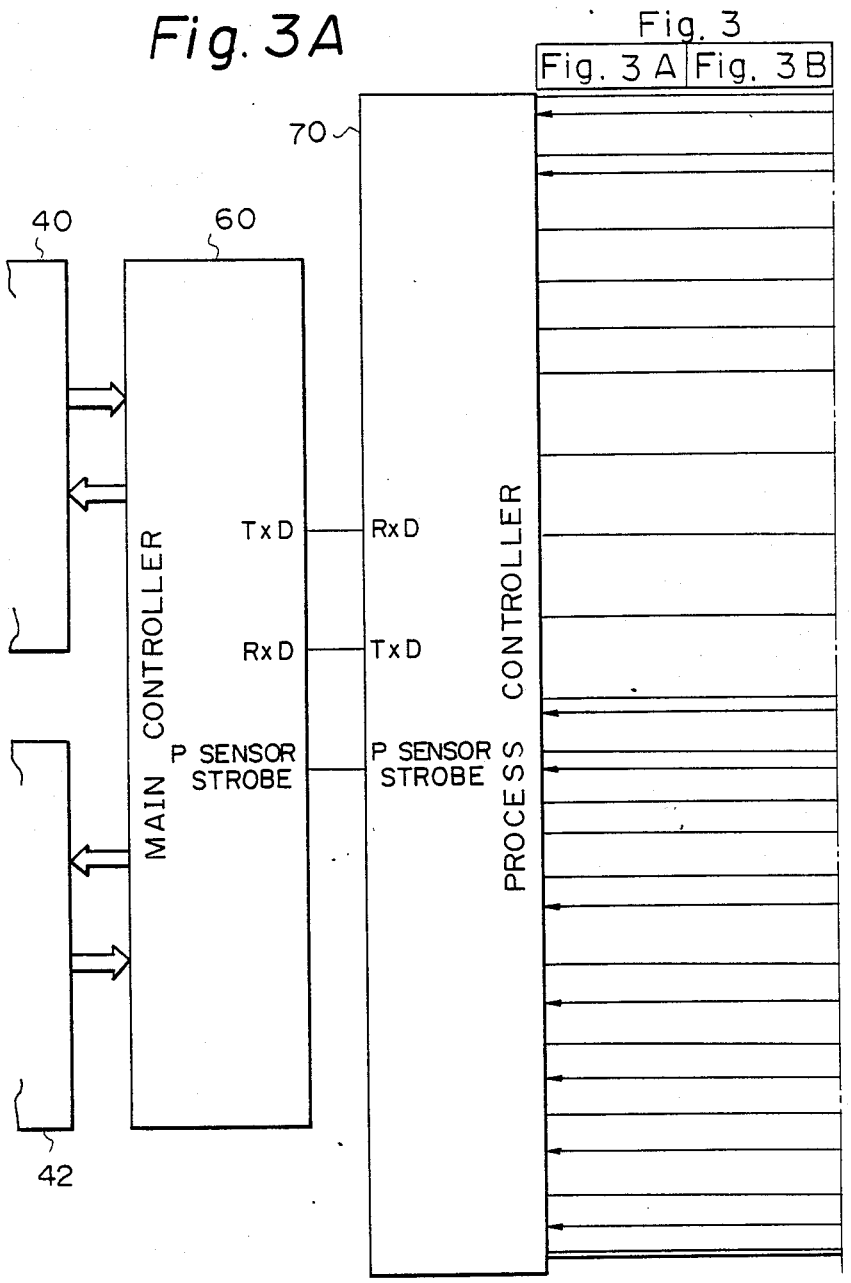
FIG. 3A, FIG. 3B is a schematic block diagram showing a control system embodying the present invention.
Figure 3B:
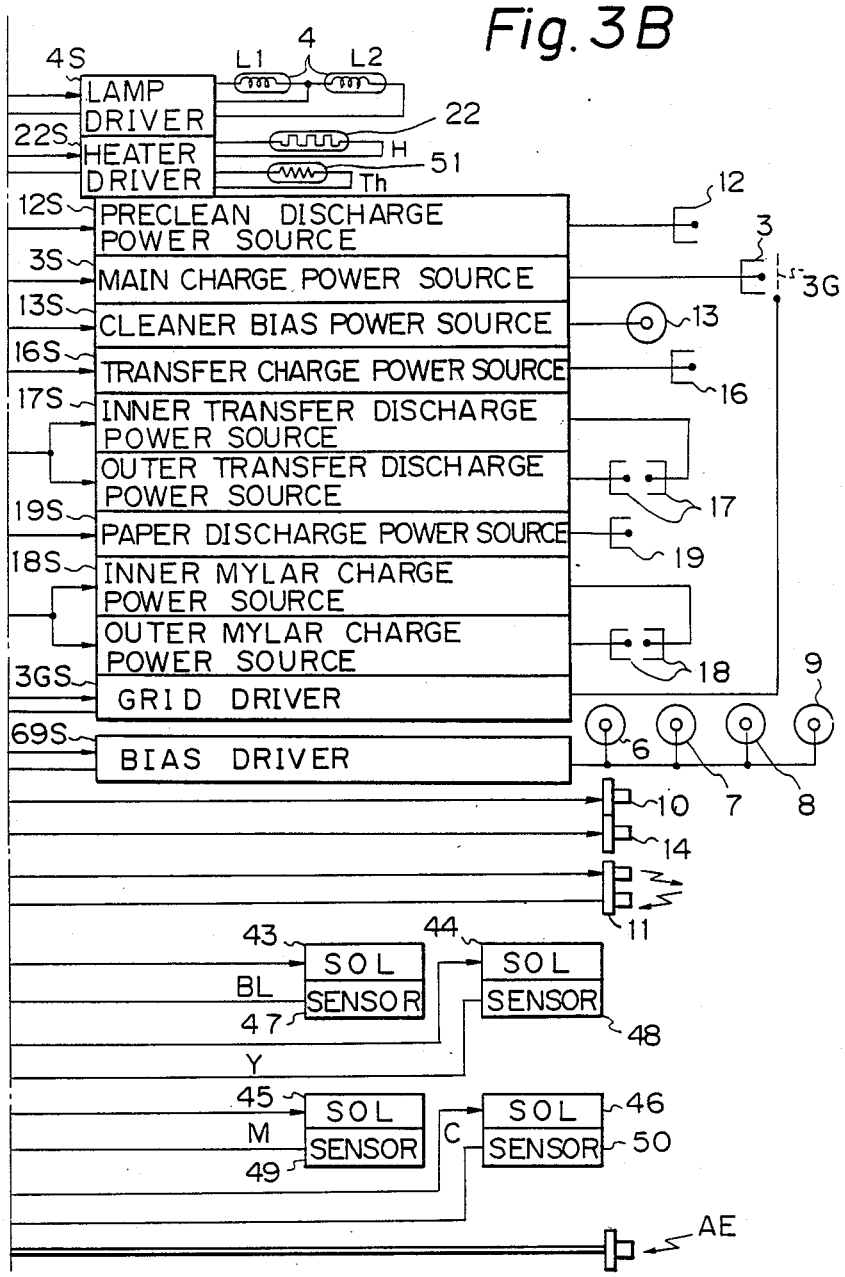

Referring to FIG. 3, a control system embodying the present invention is shown which is applied to the color copier of FIG. 1. In the figure, a process controller 70 whose major component is a microprocessor constitutes the heart of the control system. The various control units previously stated are connected to the process controller 70. A main controller 60 sets, in response to key inputs on an operation and display board 39, a desired copy mode, a number of copies to be produced, copy density and tone while determining energizing levels of the various processing units. At the same time, the main controller 60 supplies the process controller 70 with data indicative of the set energizing levels. As soon as the print key of the copier is pressed, the main controller 60 generates sequence signals commanding ON/-OFFs of the control units while setting the color filter 38 and controlling the drive of drums and paper feed and discharge mechanisms. The set data and sequence signals are fed to the process controller 70 by a single communication line (TxD). Fed from the main controller 60 to the process controller 70 over another line is a P sensor strobe which is a timing signal for sensing the density of the toner image of the solid mark 11M.

The process controller 70 receives the set energizing level data associated with the various control units via its receive ports RxD to control the energizing levels and receives the sequence signals via the receive port RxD to ON/OFF control the control units. The process controller 70 reads a fixing temperature sensed by the thermistor 51, recording density sensed by the P sensor 11, document image density read by the sensor AE, Y toner density sensed by the sensor 48, M toner density sensed by the sensor 49. C toner density sensed by the sensor 50, and BL toner density sensed by the sensor 47, delivering those values to the main controller 60 over a transmit line TxD. Further, the process controller 70 converts voltages and currents to be applied to the various control units into digital values and controls the energizing levels such that the digital values coincide with the levels set by the main controller 60. Another function of the process controller 70 is determining whether or not the control units are normal and, if any of them is not normal, transmits data representative of such a condition to the main controller 60.

Figures 4, 4A:
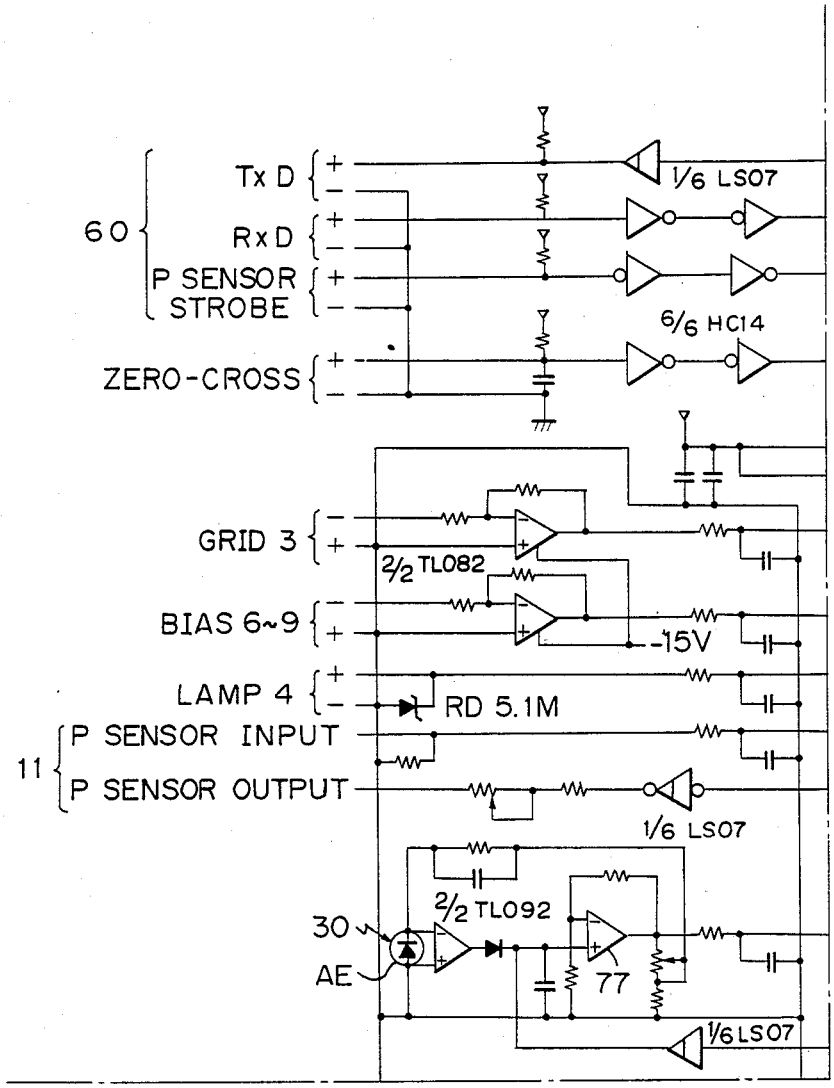
FIGS. 4A and 4B are schematic block diagrams showing, when combined together, a specific construction of a process controller which is included in the control system of FIG. 3.
Figure 4B:
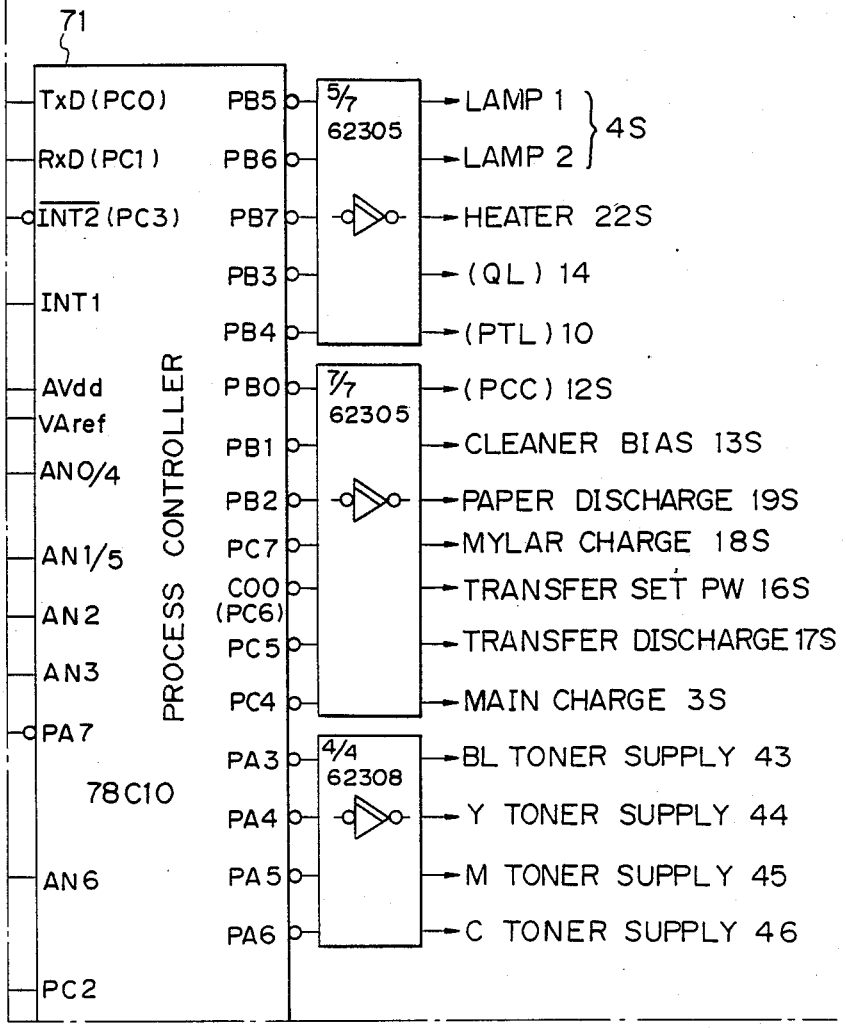
Figure 4C:
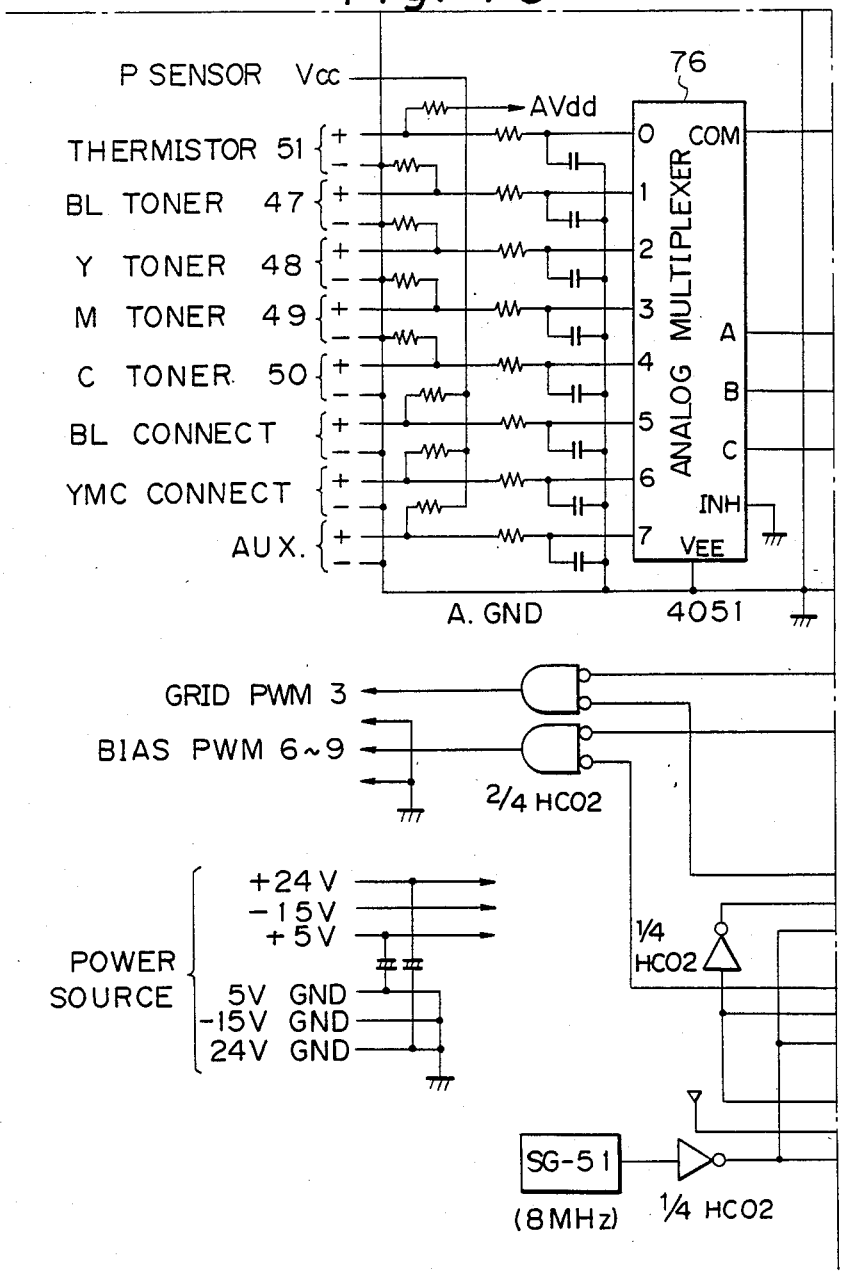
Figure 4D:
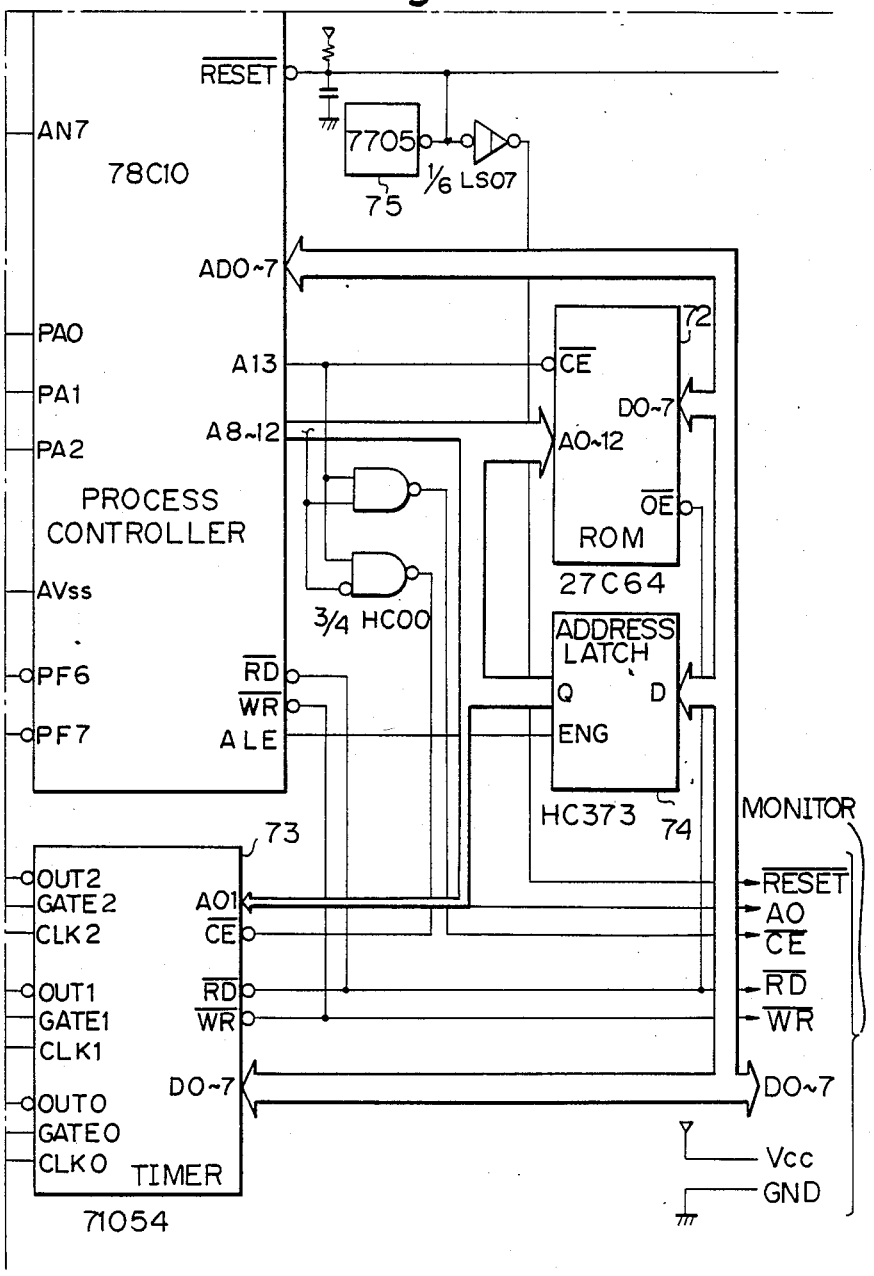

Referring to FIGS. 4A and 4B, a specific construction of the process controller 70 is shown. As shown, the process controller 70 includes a microprocessor 71 with which a read only memory (ROM) 72, a timer/-counter 73, and address latch 74 and a power ON reset 75 are associated in the form of a peripheral LSI. The microprocessor 71 interchanges data with the main controller 60 via a serial transmit port TxD and a serial receive port RxD thereof. The P sensor strobe is applied to an interrupt port INT2 of the microprocessor 71 from the main controller 60. The significance of the P sensor strobe has been stated earlier. Applied to an interrupt port INT1 are zero-cross pulses indicative of the zero-crossing points of an AC power source. Based on the zero-cross pulses, the processor 71 controls the phases of the exposing lamp 4 and fixing heater 22.

Among analog input terminals AN0 to AN7 of the processor 71, AN0 and AN4 are assigned to the detection of a grid voltage of the main charger 3 (analog-to-digial conversion of 3G potential), AN1 and AN5 are assigned to the detection of a bias voltage of the developing units (6 to 9) (analog-to-digital conversion of bias voltage), AN2 is assigned to the detection of a voltage of the lamp 4 (analog-to-digital conversion of lamp voltage), AN3 is assigned to the detection of the solid pattern on the drum 1 (analog-to-digital conversion of recording density signal), and AN6 is assigned to the detection of document density (analog-to-digital conversion of document image density signal). Connected to the input terminal AN7 is an output terminal of an analog multiplexer 76 which has eight input terminals in total. Data representative of "0" to "7" are selectively applied to select data terminals PA0 to PA2 which are connected to the multiplexer 76. Then, an analog voltage applied to a first input terminal 0 of the analog multiplexer 76 (output of thermistor 51), an analog signal applied to a second terminal 1 (output of sensor 47), an analog voltage applied to a third terminal (output of sensor 48), an analog voltage applied to a fourth input terminal (output of sensor 49), an analog voltage applied to a fifth input terminal 4 (output of sensor 50), a BL developing unit connect signal applied to a sixth terminal 5, a YMC developing unit connect signal applied to a seventh input terminal 6, and an auxiliary input signal applied to an eighth terminal 7 are selectively fed to the analog input terminal AN7 of the processor 71.

The grid voltage is detected by voltage detecting means built in a grid drive circuit 3GS, the bias voltage is detected by voltage detecting means built in a bias drive circuit 69S, the lamp voltage is detected by voltage detecting means built in a lamp drive circuit 4S, and the fixing temperature is sensed by the thermistor 51. An analog-to-digital (A/D) converter power supply terminal, a reference voltage terminal and an analog ground terminal included in the block of the processor 71 are labeled AVdd, VAre and AVss, respectively. A signal commanding ON/OFF of a light emitting diode (LED) which serves as a light source of the P sensor 11 is applied to an output port PA7 of the processor 71. Applied to an output port PC2 is a signal for activating a peak hold circuit (peak hold start) which is adapted to sense document density (AE) and mainly constituted by a operational amplifier 77. Applied to output ports PA0 to PA2 are the previously mentioned select data for the analog multiplexer 76. Further, applied to output ports PF6 and PF7 are pulse width modulation (PWM) signals for generating a main charger grid voltage and a developing bias voltage each having the set value. The grid voltage PWM signal and the bias voltage PWM signal respectively appear on output ports OUT1 and OUT2 of a timer 73. Data for determining high level intervals and low level intervals of PWM are loaded in the timer 73 under the control of the processor 71.

Signals for ON/OFF controlling the BL, Y, M and C toner supply solenoids 43 to 46 are fed to output ports PA3 to PA6. Applied to output ports PB0 to PB7 are an ON/OFF signal for controlling the precleaning discharge power source 12S, an ON/OFF signal for controlling the cleaner bias power source 13S, an ON/OFF signal for controlling the paper discharge power source 19S, an ON/OFF signal for controlling the discharge lamp 14, a signal for ON/OFF controlling the pretransfer discharge lamp 10, an ON/OFF signal for controlling the exposing lamp 2 ($L_2$ of 4), and an ON/OFF signal for controlling the heater 22 (ON/OFF in one AC cycle in phase control), respectively. Further, applied to output ports PC4, PC5 and PC6 are a main charger power source 13S ON/OFF signal, a transfer discharge power source 17S ON/OFF signal, and a Mylar charger power source 18S ON/OFF signal. Appearing on an output port COO (PC6) is a PWM signal for setting a voltage for the transfer charger power source 17S. The power ON reset signal is fed to an input terminal RESET. Labeled AD0 to AD7 are lower address/data bus terminals, and RD, WR ALE are respectively a read signal output terminal, a write signal output terminal and an address latch signal output terminal. In FIG. 4B, a monitor terminal is adapted for the connection of a monitor (not shown) when it is desired to monitor the data bus of the processor 71.

Figures 5, 5A, 5B:
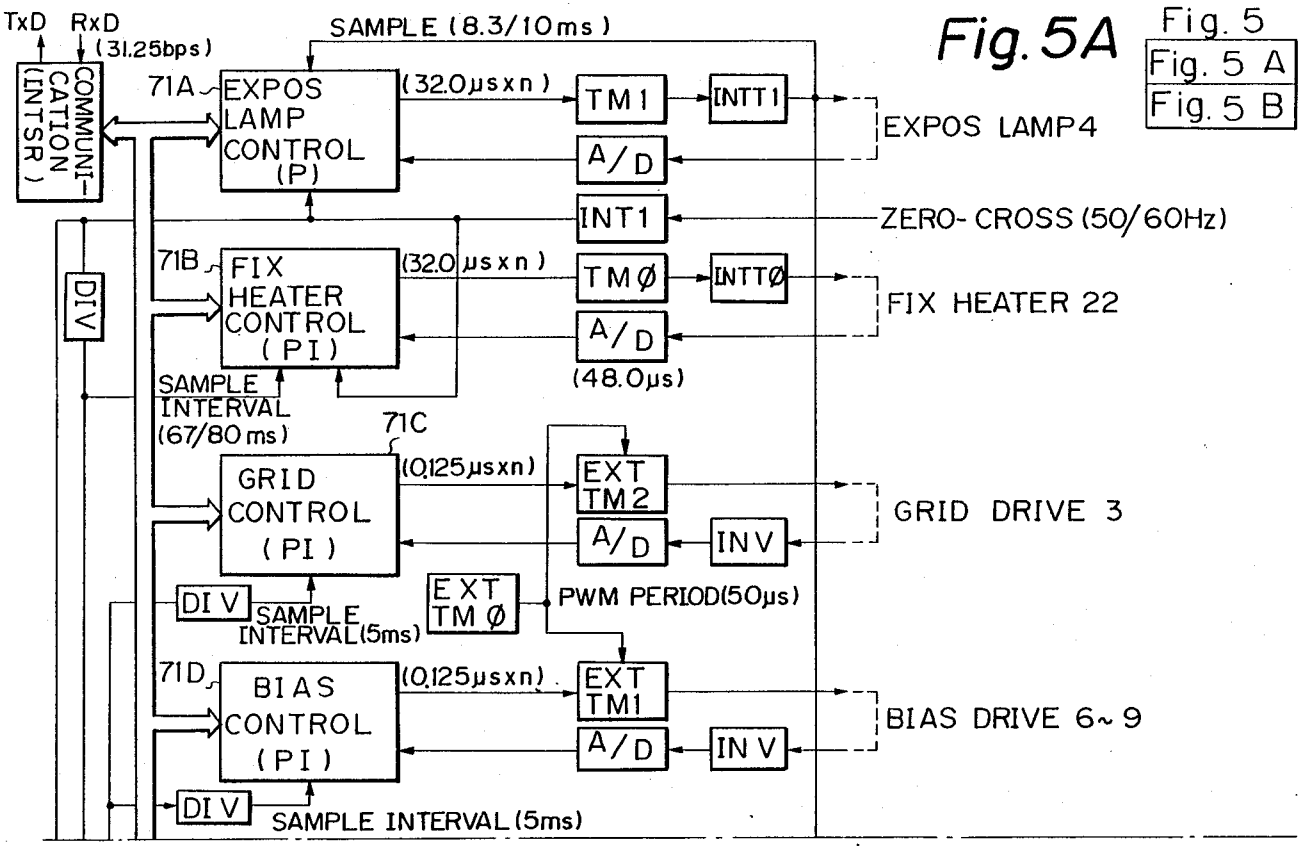
FIGS. 5A and 5B are block diagrams representative of, when combined together, major functions of the process controller.
Figure 7A:
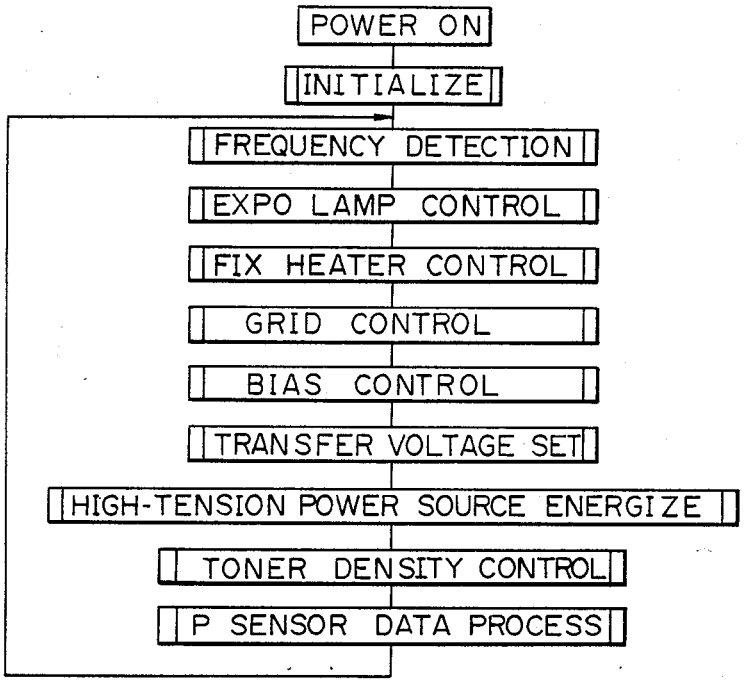
FIG. 7A is a flowchart outlining the operation of the microprocessor.
Figure 7B:
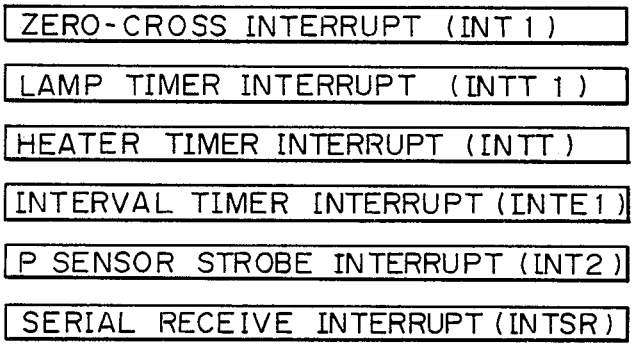
FIG. 7B shows interrupt processing items which the microprocessor execute.
Figure 8:
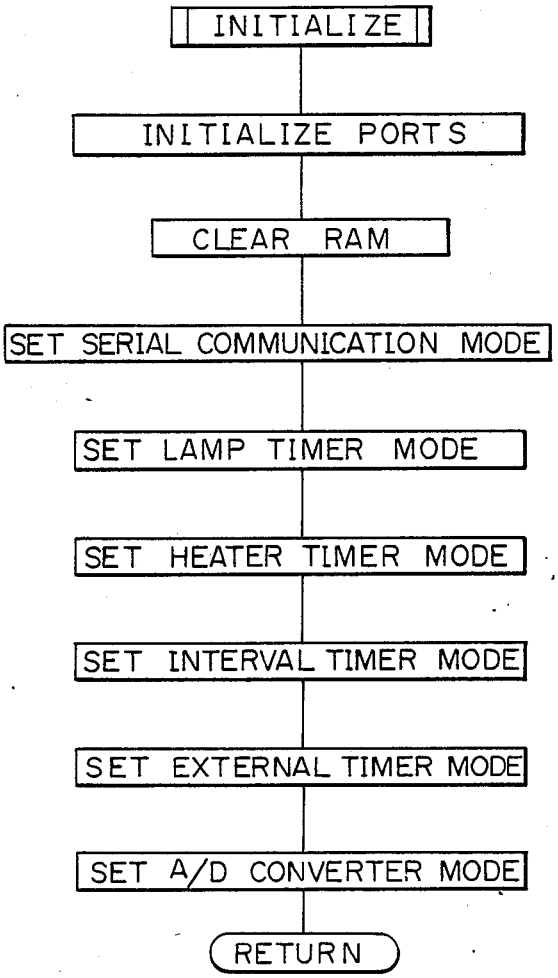
FIGS. 8 to 23, 24, which consist of FIGS. 24A and 24B, 25, which consist of FIGS. 25A and 25B, and 26 to 28 are flowcharts showing details of the control executed by the microprocessor.
Figure 9:
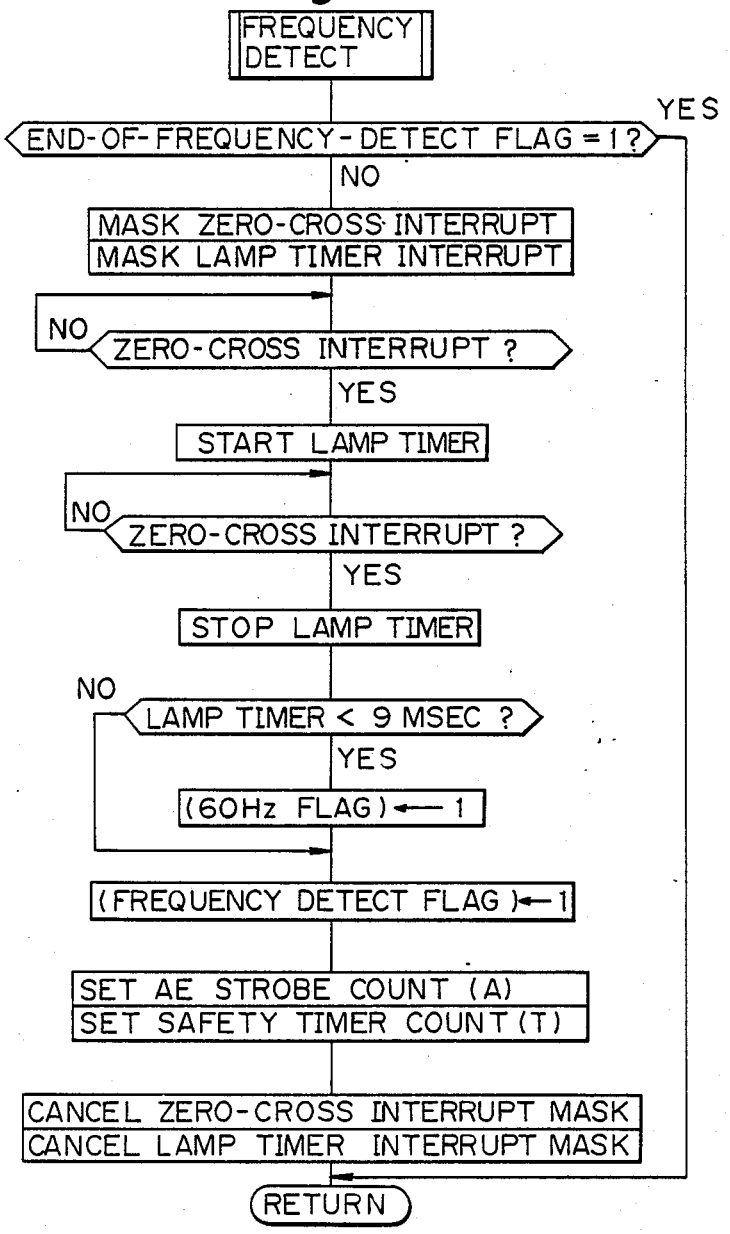
Figure 10:
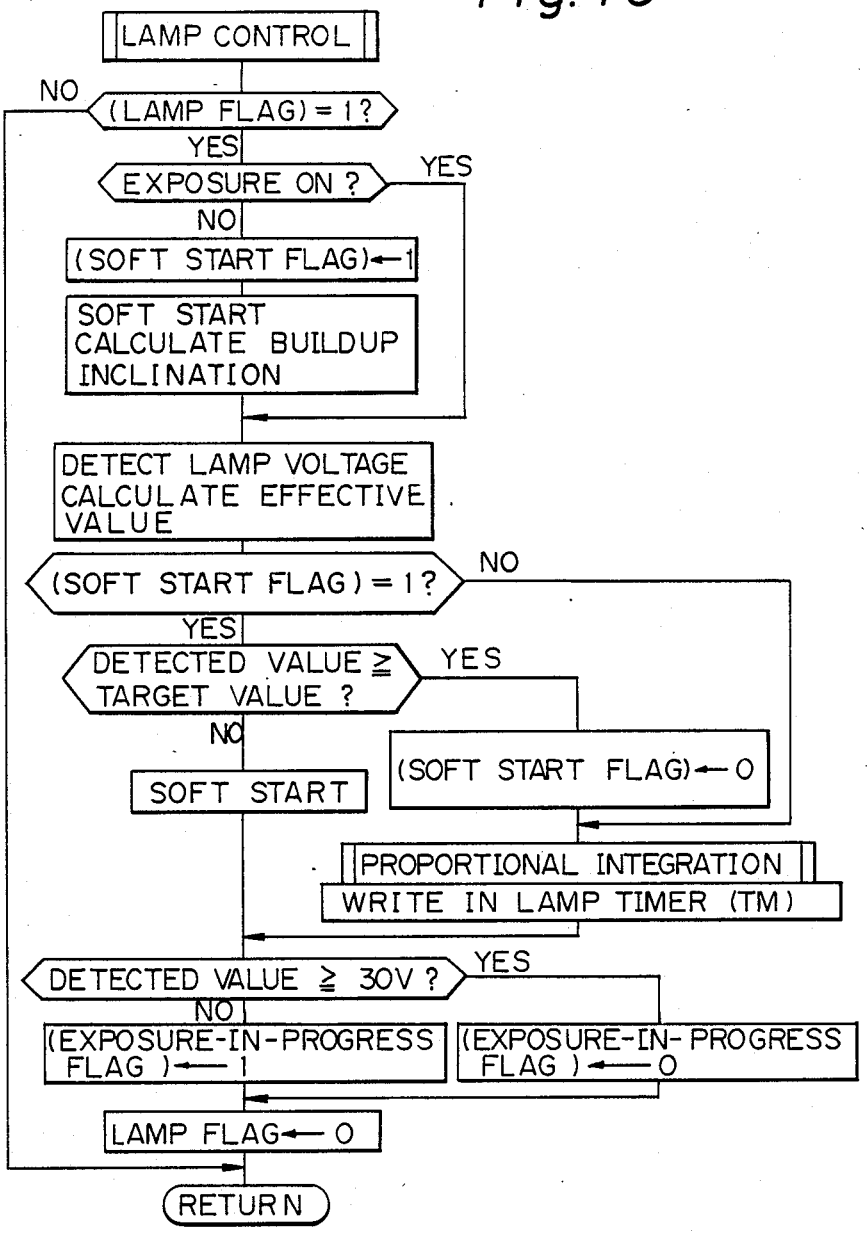
Figure 11:
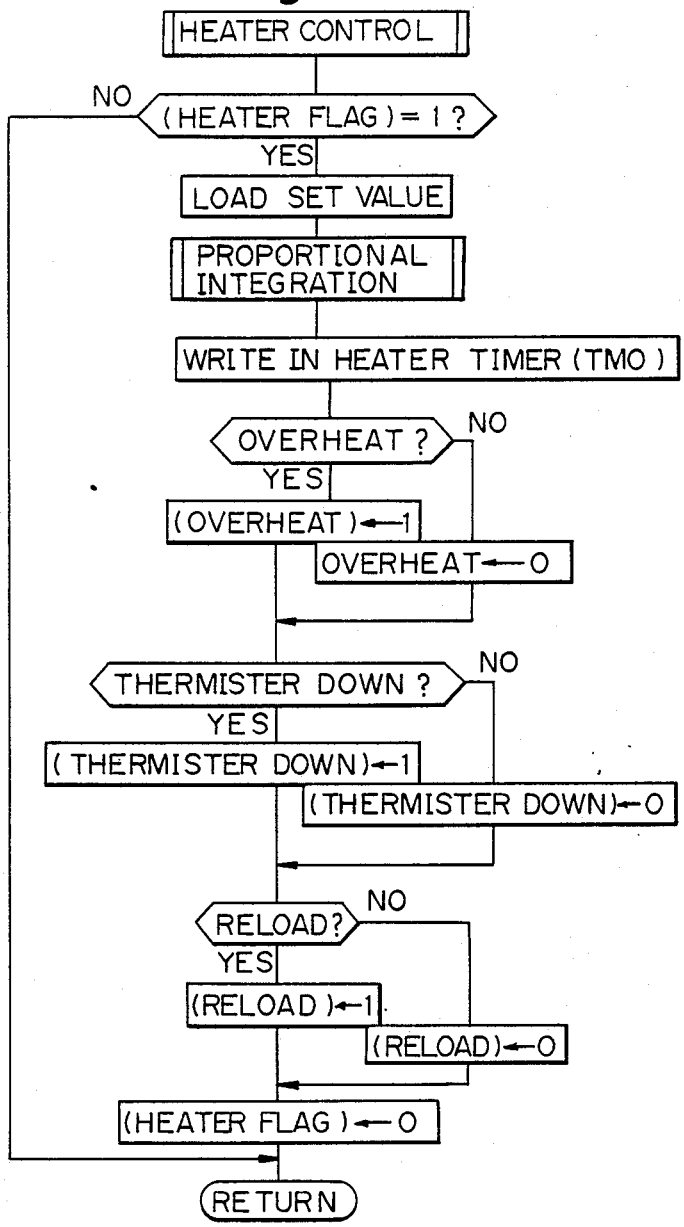
Figure 12:
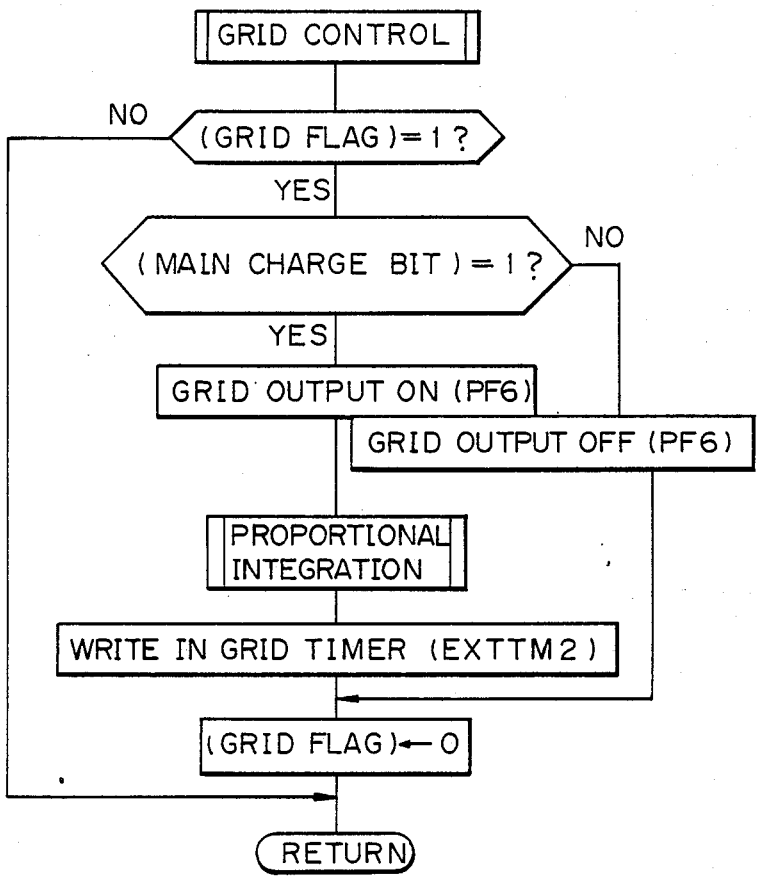
Figure 13:
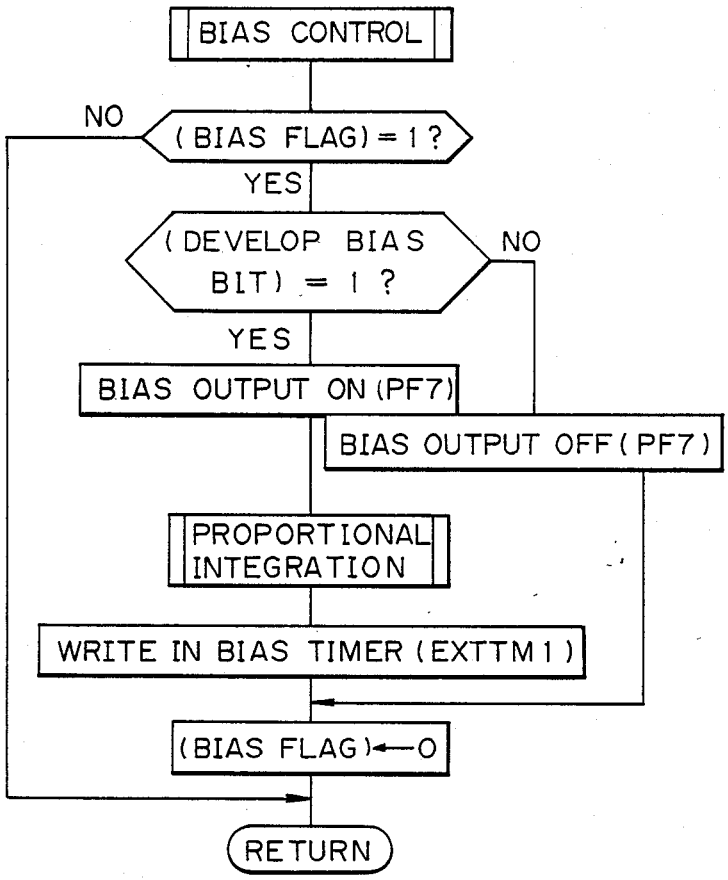
Figure 14:
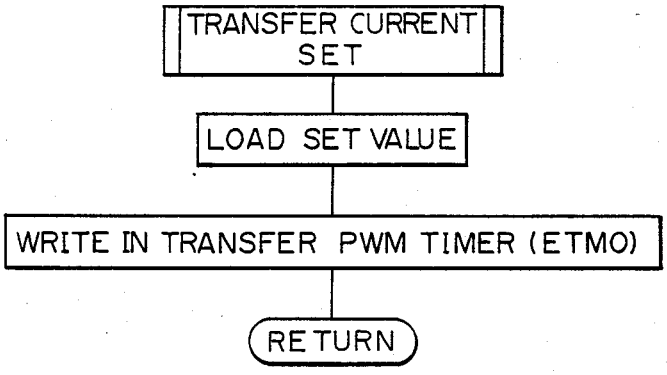
Figure 15:
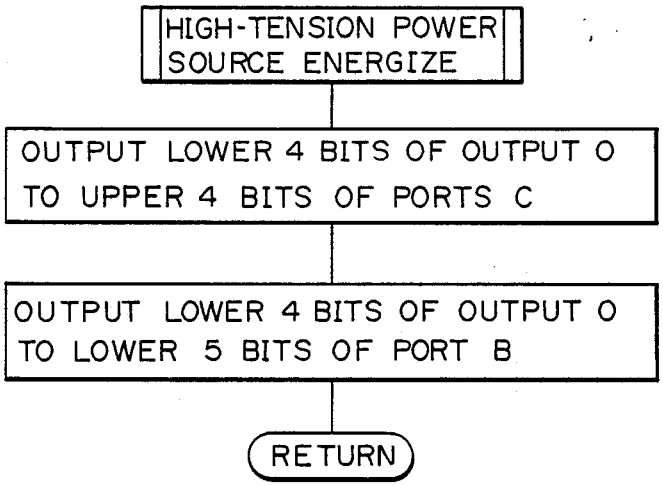
Figure 16:
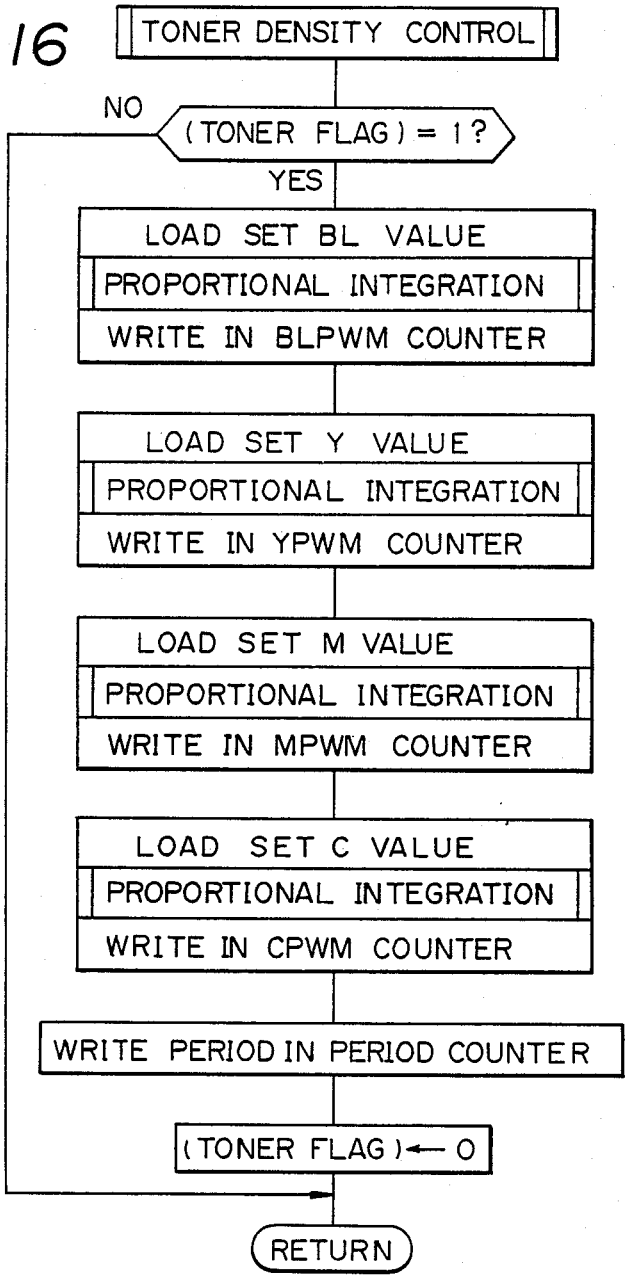
Figure 17:
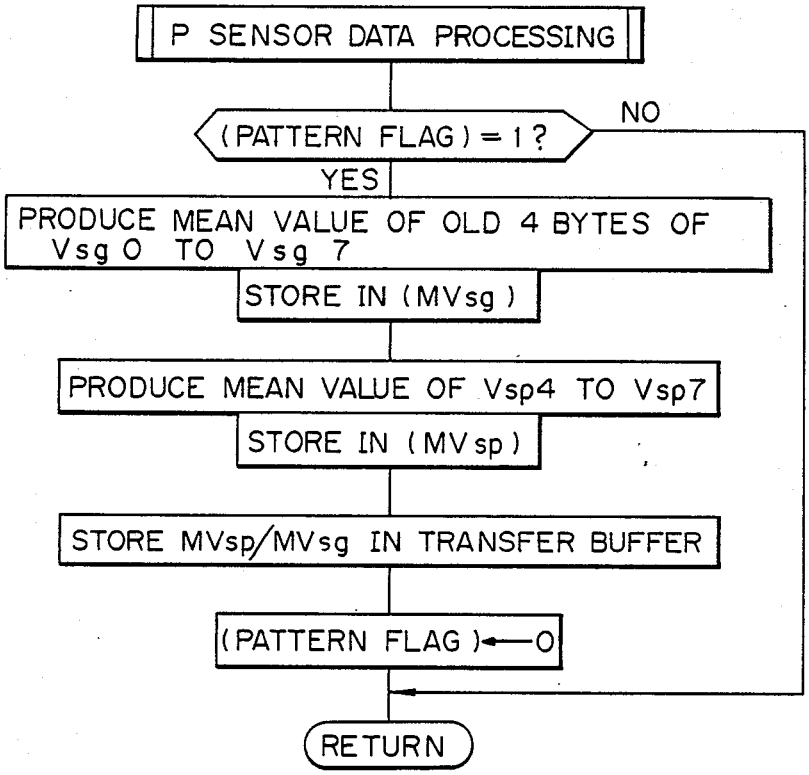

The control procedure performed by the processor 71 is as follows. FIGS. 5A and B show a principal part of the control procedure in function blocks while FIGS. 7A to 28 show the individual functions in detail in flowcharts. Further, FIG. 29 shows in a memory map major data which are stored in a RAM built in the processor 71 and associated with the execution of the control. FIG. 7 shows principal functions included in the control while FIG. 7B shows interrupt processing items.

[COMMUNICATION]

First, the communication of the processor 71 with the main controller 60 which is executed by SERIAL RECEPTION INTERRUPT (INTSR) will be described. The main controller 60 sends to the processor 71 various data which are listed in Tables 1 and 3 shown below.

TABLE 1

| | TRANSMIT DATA (71 ← 60; 1 BYTE) BIT NO. | | | | | | | |
|---|---|---|---|---|---|---|---|---|
| NO. | 7 | 6 | 5 | 4 | 3 | 2 | 1 | 0 |
| 0 | 0 | 0 | DEVELOP BIAS | AE STROBE | MYLAR CHARGE | TRANSFER CHARGE | TRANSFER DISCHARGE | MAIN CHARGE |
| 1 | 0 | 1 | LAMP 2 | EXPOSURE | C SUPPLY INHIBIT | M SUPPLY INHIBIT | Y SUPPLY INHIBIT | BL SUPPLY INHIBIT |
| 2 | 1 | 0 | 0 | COLOR SELECT DATA | | | ADDRESS DATA | |

Note: Data Nos. 0 and 1 are ON/OFF (1 bit) data. Color selection data are shown in Table 2 below.

TABLE 2

| BIT NO. | | SPECIFIED BY DATA |
|---|---|---|
| 4 | 3 | COLOR |
| 0 | 0 | Y |
| 0 | 1 | M |
| 1 | 0 | C |
| 1 | 1 | BL |

TABLE 3

| | TRANSMIT DATA II (71 ← 60; 1 BYTE) BIT NO. | | | | | | | |
|---|---|---|---|---|---|---|---|---|
| NO. | 7 | 6 | 5 | 4 | 3 | 2 | 1 | 0 |
| 0 | 0 | 0 | HEATER CONTROL | HEATER OFF | QL/PTL | PAPER DISCHARGE | CLEANER BIAS | PRECLEANING DISCHARGE |
| 1 | SET TONER DENSITY DATA (COLOR-BY-COLOR) | | | | | | | |
| 2 | SET LAMP VOLTAGE DATA | | | | | | | |
| 3 | SET GRID VOLTAGE DATA | | | | | | | |
| 4 | SET DEVELOP BIAS VOLTAGE DATA | | | | | | | |
| 5 | SET TRANSFER CHARGE VOLTAGE DATA | | | | | | | |
| 6 | SET HEATER TEMPERATURE DATA | | | | | | | |

At the timings for feeding the ON/OFF data (sequence signal) Nos. 0 and 1 shown in Table 1 to the processor 71, the main controller 60 transmits byte data of Nos. 0 and 1 to the processor 71. When the main controller 60 is to deliver the ON/OFF data No. 3 (sequence signal) shown in Table 3 to the processor 71, it transmits to the processor 71 one byte of No. 2 of Table 1 as data for designating No. 0 of Table 3 and then transmits one byte of No. 0 of Table 3. In the event of transmission of set Y toner density, the main controller 60 transmits to the processor 71 one byte of No. 2 of Table 1 and address data as data for designating selected color data Y and data for designating No. 1 of Table 3, respectively, and then selects one byte of No. 1 of Table 3 as data indicative of set Y toner density and feeds it to the processor 71. Set density values associated with M, C and BL toner will be transmitted to the processor 71 in the same manner. Briefly, the main controller 60 usually transmits data (sequence control signal) shown in Table 1 in the order of No. 0, No. 1, No. 0 and so on and, when one of the data of Table 3 has to be transmitted, transmits the required data of Table 3 after No. 0 and No. 1 of Table 1.

Every time the processor 71 receives one byte from the main controller 60, it transmits to the main controller 60 data which are indicative of sensed values associated with the various control units. Table 4 shown below lists the contents of such data to be transmitted from the processor 71 to the main controller 60.

TABLE 4

| | TRANSMIT DATA III (60 ← 71; 1 BYTE) BIT NO. | | | | | | | |
|---|---|---|---|---|---|---|---|---|
| NO. | 7 | 6 | 5 | 4 | 3 | 2 | 1 | 0 |
| 0 | SYNC CHARCTER (FFH) | | | | | | | |
| 1 | 0 | BL CONNECT | YMC CONNECT | THERMIS-TOR DOWN | OVER-HEAT | RELOAD | EXPO-SURE FAILURE | EXPOS-ING |
| 2 | SENSED FIX TEMP DATA | | | | | | | |
| 3 | SENSED RECORD DENSITY (P SENSOR) DATA | | | | | | | |
| 4 | SENSED DOCUMENT DENSITY (AE SENSOR) DATA | | | | | | | |
| 5 | SENSED Y TONER DENSITY DATA | | | | | | | |
| 6 | SENSED M TONER DENSITY DATA | | | | | | | |
| 7 | SENSED C TONER DENSITY DATA | | | | | | | |
| 8 | SENSED BL TONER DENSITY DATA | | | | | | | |

The communication between the main controller 60 and the microprocessor 71 asynchronous. The processor 71 takes in the data (Tables 1 and 3) from the controller 60 by RECEIVE INTERRUPT and transmits the data (Nos. 0 to 8 of Table 4) to the controller 60.

Figure 24A:
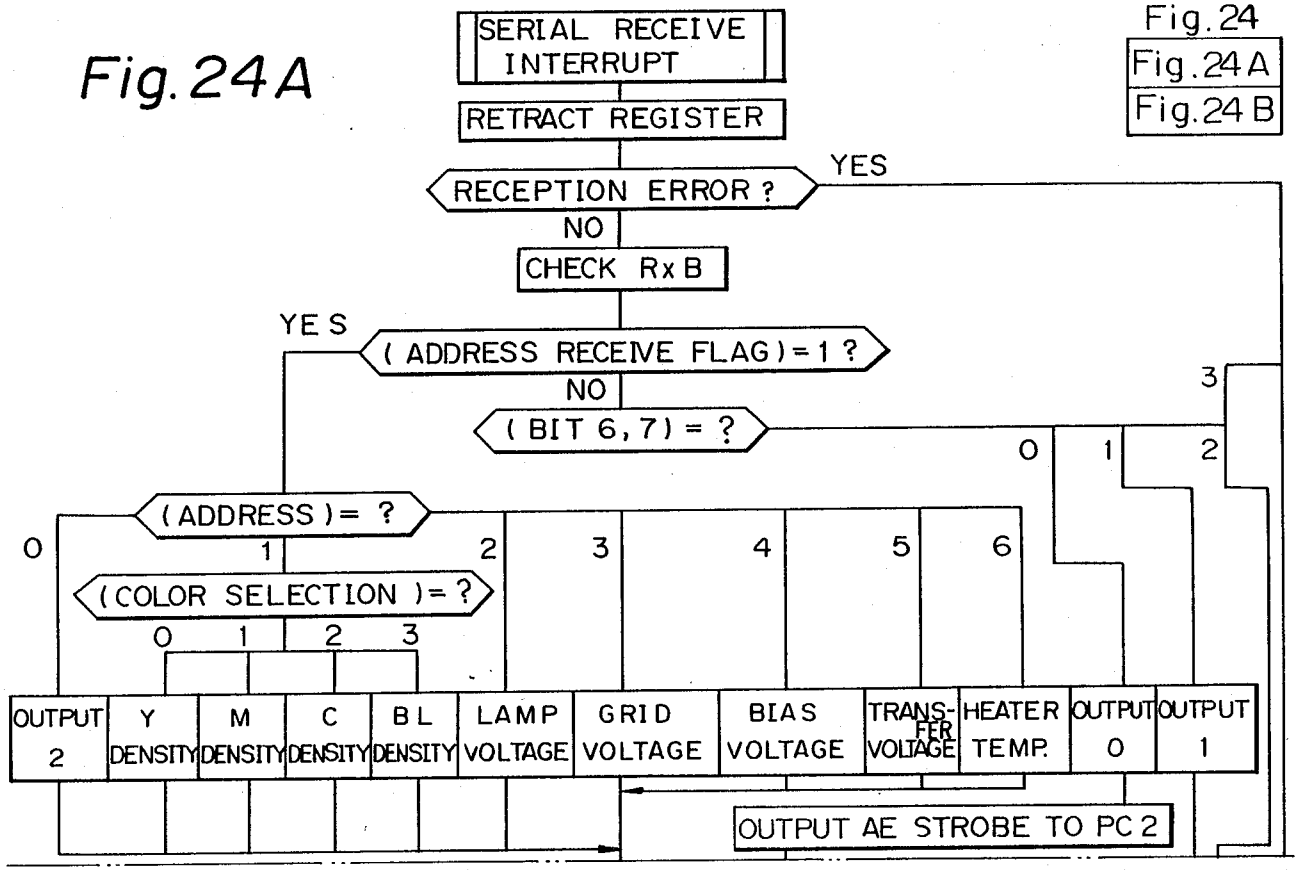
Figure 24B:
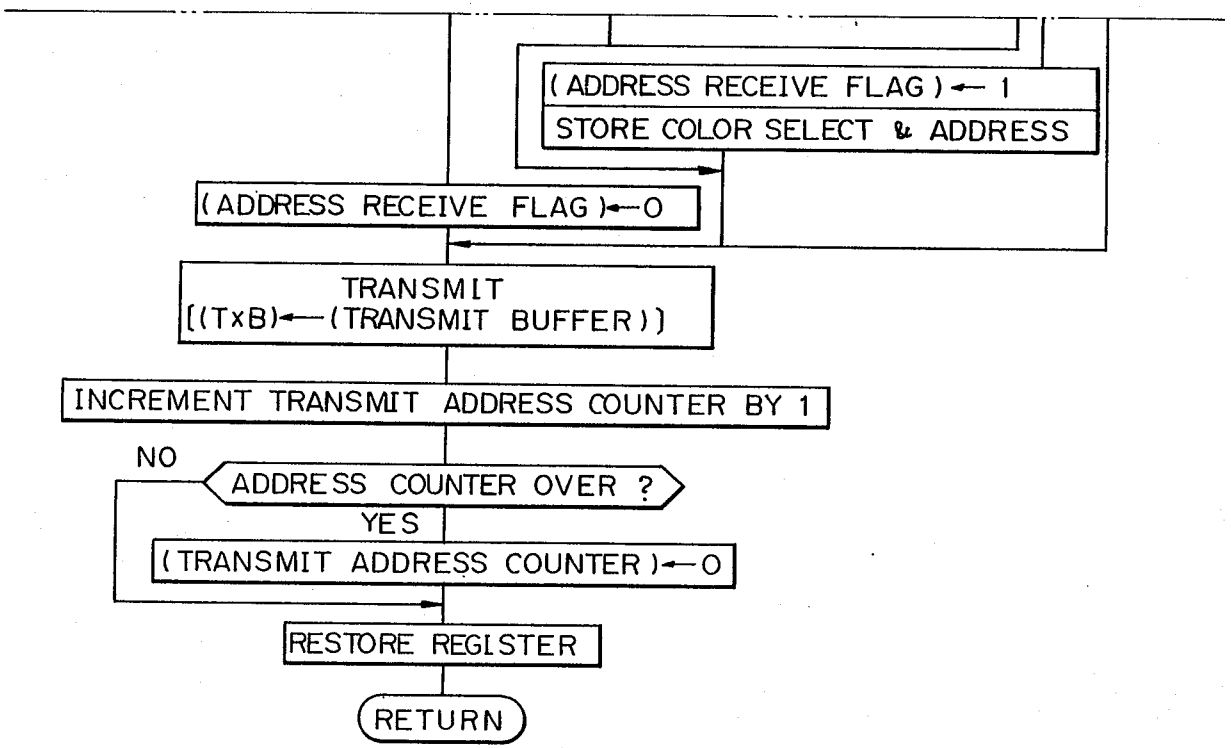

FIG. 24 shows the contens of the previously mentioned reception and transmission control operations (SERIAL RECEPTION INTERRUPT (INTSR)) performed by the microprocessor 71. When the processor 71 receives data from the main controller 60 at its receive port RxD, it advances to SERIAL RECEIVE INTERRUPT and reads data (one byte) there. Then, the processor 71 checks data of bit Nos. 6 and 7 of the data (two bits in total) and, if they are representative of a numerical value of one or zero (data No. 0 or No. 1 of Table 1) meaning that another one byte of data (Table 3) is to follow, writes a (logical) ONE in an address receive flag register, writes "color select data" and "address data" included in the received data in predetermined registers, and then awaits another one byte of data to follow. Upon the arrival of another one by of data, the processor 71 writes it in a predetermined register regarding that the data is the data indicated by the "address data" of Table 3. When the "address data" is representative of No. 1 of Table 3, the program references the "color select data" and thereby selects a particular register (assigned to a particular color). In any case, every time the processor 71 receives one byte of data, it sends all the data (Nos. 0 to 8) of Table 4 being held to the main controller 60. It is to be noted that the word "register" stated above and will appear hereinafter refers to a writing area of the internal RAM of the microprocessor 71 and assigned to each of different data, as shown in FIG. 29.

[OUTLINE OF MAIN FLOW (FIG. 7A)]

As soon as the microprocessor 71 is powered, it executes a control according to the main routine shown in FIG. 7A. Specifically, it initializes the system, then executes the sequences of steps from frequency detection to P sensor data processing, and then repeats such a sequence of steps. When a predetermined signal appears within or outside of the processor 71, the processor 71 executes interrupt processing (FIG. 7B) associated with the signal.

Hereinafter will be described the various controls (subroutines) shown in FIG. 7A and the interrupt processing shown in FIG. 7B. The controls and interrupt procesing will be better understood when a reference is made also to FIGS. 5A and 5B.

[INITIALIZE (FIG. 8)]

The processor 71 initializes its RAM, output ports, serial transmit port, timer 73, A/D converter, etc.

[FREQUENCY DETECTION]

The processor 71 measures the frequency of ZERO-CROSS INTERRUPT only once by using a lamp phase angle timer TM1 and, if TM1 is shorter than 9 milliseconds, determines that the frequency is 60 hertz and, if otherwise, that the frequency is 50 hertz. Although masking LAMP TIMER INTERRUPT (INTT1) and ZERO-CROSS INTERRUPT will allow no interruption to occur, it is possible to see if a zero-cross input has occurred because an interrupt request flag is set. After the frequency has been determined, preset values A and T are respectively loaded in an AE strobe counter and a safety timer each being dependent upon the frequency.

[EXPOSING LAMP CONTROL (71A IN FIG. 5A AND FIG. 10)]

The outline of this control will be discussed first. Voltage applied to two exposing lamps 4 ($L_1$ an $L_2$) is stabilized and caused to follow the set value which is fed from the main controller 60. This is implemented by detecting the lamp terminal voltage, converting it into a digital value, and calculating preset data to be loaded in the phase angle timer 73 (TM1) from a root of the digital value and the target value fed from the main controller 60. As soon as TM1 started by ZERO-CROSS IN- TERRUPT (INT1) reachs the preset data, the timer 73 turns on the lamps 4 and turns them off in response to ZERO-CROSS INTERRUPT (INT1).

In detail, an effective value is calculated from the lamp voltage sampled by LAMP TIMER INTERRUPT (INTT1) which will be described (FIG. 20), the effective value and the target value fed from the main controller are used to calculate a lamp phase angle to be loaded in the lamp timer by proportional integration, and then the lamp timer is updated. When PROPORTIONAL OPERATION subroutine (FIG. 18) is to be called, a flag showing if the operation is a proportional operation or a proportional integration operation and a flag showing if the timer 73 is in an up-count mode or a down-count mode are set. For the lamp control, a proportional operation is executed and the timer is held in an up-count mode. At an initial stage of exposure, the phase angle is sequentially increased to execute a so-called soft start. The lamp voltage is constantly sampled and, if it is higher than 30 volts, an expose-in-progress bit is set. This routine is executed only when a lamp flag indicative of the end of lamp voltage sampling is set, i.e., it will be skipped if such a flag is reset.

[HEATER CONTROL (71B OF FIG. 5A AND FIG. 11)]

The surface temperature of the fixing roller 21 in which the heater 22 is accommodated is controlled for stabilization and caused to follow the set value fed from the main controller 60. Specifically, the terminal voltage of the thermistor 51 which is pressed against the fixing roller 21 is converted into a digital value. This digital value and the target value fed from the main controller 60 are used to calculate preset data to be loaded in the phase angle timer 73 (TM0). Such a routine is executed only when a heater flag indicative of the end of fixing temperature sampling is set, as in the lamp control. First, a value to be loaded in the timer 73, i.e., heater phase angle is calculated from the fixing temperature sampled by ZERO-CROSS INTERRUPT (INT1) and the target value from the main controller 60 by proportional integration and, then, the timer 73 is updated. When PROPORTIONAL INTEGRATION subroutine is to be called, a flag showing if the operation is a proportional operation or a proportional integration operation and a flag showing if the timer 73 is in an up-count mode or a down-count mode are set. For the lamp control, proportional integration is executed and the timer 73 is operated in an up-count mode. Subsequently, the sampled fixing temperature is checked to see if the fixing roller is overheated, if the thermistor is broken, and if a reload state, i.e., fixable temperature is reached, and status bits associated with such decisions are manipulated.

[GRID VOLTAGE CONTROL FOR MAIN CHARGER (71C IN FIG. 5A AND FIG. 12)]

The voltage applied to the grid 3G of the main charger 3 is controlled to a stable state and caused to follow the set value fed from the main controller 60. This control is effected by detecting the grid potential, inverting the potential by an inverting amplifier (grid potential being negative), converting the inverted potential to a digital value, and calculating data to be preset in a PWM pulse width timer (EXTTM2) from the digital value and the target value fed from the main controller 60. The timer EXTTM2 turns of the grid drive circuit 3GS in response to every underflow and turns on the circuit 3GS at each period of a PWM pulse period timer (EXTTM0). More specifically, PWM pulses having a period of EXTTM0 and a pulse width of EXTTM1 are fed to the grid drive circuit 3GS. This routine, too, is executed only when a grid flag showing the end of grid voltage sampling is set. The grid ON/OFF timing is the same as the timing of the main charger 3. If a "main charger" bit is a (logical) ONE, a grid output (PF6) is turned on to perform proportional integration while, if it is a ZERO, the grid output (PF6) is turned off.

[DEVELOPING BIAS CONTROL (71D OF FIG. 5A AND FIG. 13)]

The bias potential applied to the BL, Y, M and C developing units is stabilized and caused to follow the set value fed from the main controller 60. The control is accomplished by detecting the bias voltage, inverting the potential by an inverting amplifier (bias potential being negative), converting the inverted potential into a digital value, and calculating data to be preset in the PWM pulse width timer (EXTTM1) from the digital value and the target value sent from the main controller 60. The timer EXTTM1 turns off the bias drive circuit 69S in response to every underflow and turns it on at each period of the PWM pulse period timer (EXTTM0). More specifically, PWM pulses having whose period is EXTTM0 and pulse width is EXTTM1 are outputted. The developing bias control is executed only when a bias flag showing the end of bias voltage sampling is set. If a "developing bias" bit is a ONE, a bias output (PF5) is turned on to perform proportional integration and, if it is a ZERO, the bias output (PF5) is turned off. It is to be noted that the timers ETTM0, EXTTM1 and EXTTM2 used for the grid control and developing bias control are built in the timer 73.

[TONER DENSITY CONTROL (71E IN FIG. 5B AND FIG. 16)]

BL, Y, M and C toner density is stabilized and caused to follow the set value fed from the main controller 60. This control is achieved by calculating data to be preset in a PWM pulse width counter CNT from a digital value produced by converting an output voltage of the toner density sensor and the target value fed from the main controller 60. The counter CNT turns off the toner supply solenoids 43 to 46 in response to every underflow and turns them on and sets preset data at each PWM period. That is, PWM pulses whose pulse width is CNT are produced. This routine is executed only when a toner flag showing that the time for energizing the toner supply solenoids 43 to 46 has been reached. The set toner density received from the main controller 60 and stored in the receive buffer and the toner density sampled by ZERO-CROSS INTERRUPT (INT1) (the content will be described later) are subjected to proportional integration, and the result is written in a BL PWM counter, a Y PWM counter, an M PWM counter and a C PWM counter which are adapted to ON/OFF control the BL, Y, M and C toner supply solenoids 43 to 46, respectively.

[SETTING OF TRANSFER VOLTAGE, HIGH-TENSION POWER SOURCE, ETC. (71F IN FIG. 5B, FIG. 14 AND FIG. 15)]

The precleaning discharge power source 12S, cleaner bias voltage source 13S, paper discharge power source 19S, discharge lamp 14, pretransfer discharge lamp 10, main charger power source 3S, transfer discharge power source 16S and Mylar charger power source 18S are ON/OFF controlled, and the current for the transfer charger 16S is set up. The transfer charger current is set by a PWM system which varies the duty of pulses having a predetermined period. More specifically, timers ETM1 and ETM0 generate a predetermined period and a pulse width, respectively. Therefore, the data written in the timer ETM0 is the target transfer charger current. In TRANSFER CURRENT SET (FIG. 14), the "set transfer charger current" received from the main controller 60 and stored in the receive buffer is written in a transfer PWM timer (ETM0) In HIGH-TENSION POWER SOURCE ENERGIZE (FIG. 15), the content of "high voltage output 0" received from the main controller 60 and stored in the receive buffer (data of No. 0 in Table 1) is outputted while, at the same time, the content of "high voltage output 2" (data of No. 0 in Table 3) is outputted. All the timers TM0, TM1, ETM0 and EM1 are built in the processor 71.

[DENSITY SAMPLING (71G AND 71H IN FIG. 5B AND FIG. 6)]

To sample document density, the sensor AE associated with the exposing lamp unit senses a reflection from a document over a predetermined distance from the leading edge of the document, and the peak hold circuit (77) holds the sensor output. The peak held by the peak hold circuit is indicative of the lowest document density, i.e. background density. To sample image density as distinguished from the document density, the sensor 11 senses the density of the solid pattern (image of the solid mark 11M) which precedes an effective image on the drum 1 and the density of the background of the drum 1. The two different density values are converted into digital values and then their ratio is determined by P SENSOR DATA PROCESSING. The timing for sampling is provided by the main controller 60 in response to the P sensor strobe signal in INTERRUPT (INT2).

Figure 6:
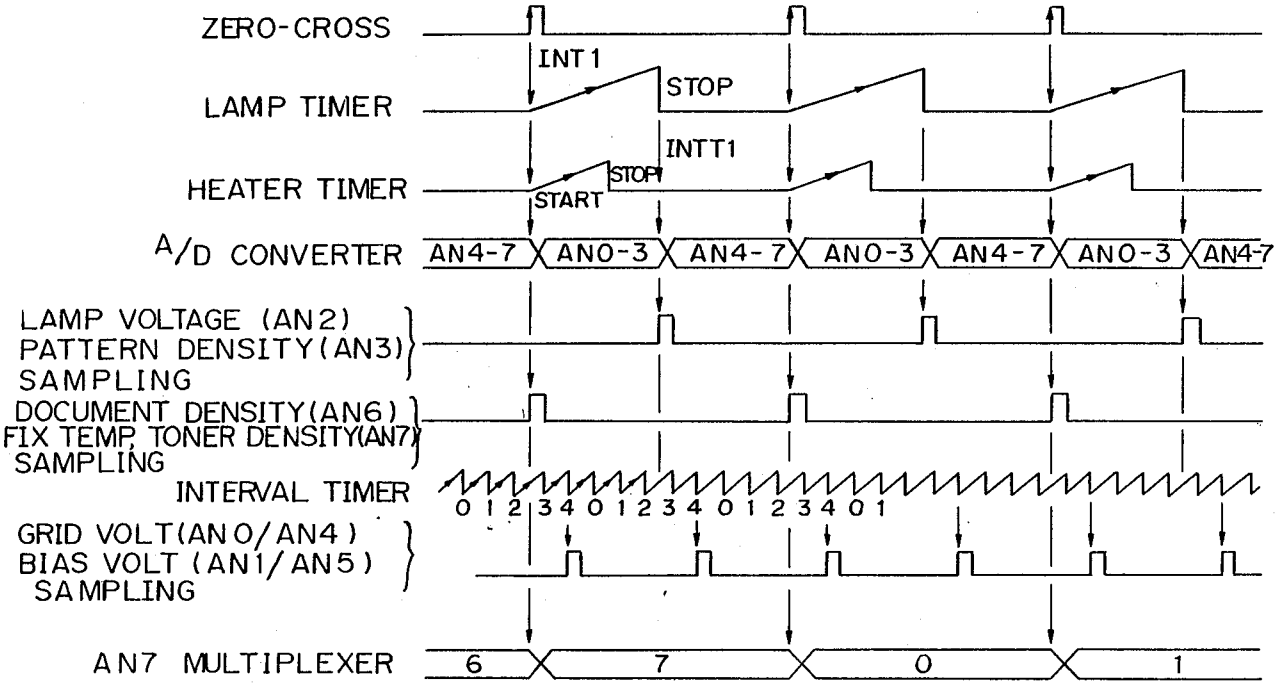
FIG. 6 is a timing chart demonstrating how the microprocessor shown in FIGS. 4A and 4B perform analog-to-digital conversion with energizing levels and other detected values in response to zero-cross pulses of an AC power source.

FIG. 6 shows sampling timings. While an A/D converter (built in the processor 71) has eight channels, the analog input terminals AN0 to AN3 and AN4 to AN7 are switched on a time division basis because only four registers are available for storing the results of A/D conversion. In the illustrative embodiment AN0 to AN3 and AN4 to AN7 are switched every time ZERO-CROSS INTERUPT (INT1) or LAMP TIMER INTERRUPT (INTT1) appears. Hence, the results stored in AN4 to AN7 cannot be taken in while AN0 to AN3 are selected, or vice versa. As regards the grid voltage, and bias voltage, the results of A/D conversion have to be constantly taken in with no regard to which of the AN0 to AN3 and AN4 to AN7 is selected. For this reason, two channels AN0 and AN4 are assigned to grid voltage. and two channels AN1 and AN5 are assigned to bias voltage.

[P SENSOR DATA PROCESSING (FIGS. 17 AND 30)]

This routine is executed only when a pattern flag showing that the density of the solid pattern on the drum 1 sensed by the P sensor 11 and the background density of the drum 1 have been sampled is set. Among image density values Vsg0 to Vsg7 of eight points of the background of the drum 1 and image density values Vsp0 to Vsp7 of eight points of the solid image, the sampled data associated with two front and two rear points on opposite sides of the borders between the background and the image portion are discarded. Then, the ratio of the mean value MVsg of the density values of the remaining four background points and the mean value of the four solid image points is produced and stored in the transmit buffer to the main controller 60.

[PROPORTIONAL INTEGRATION (FIG. 18)]

Figure 18:
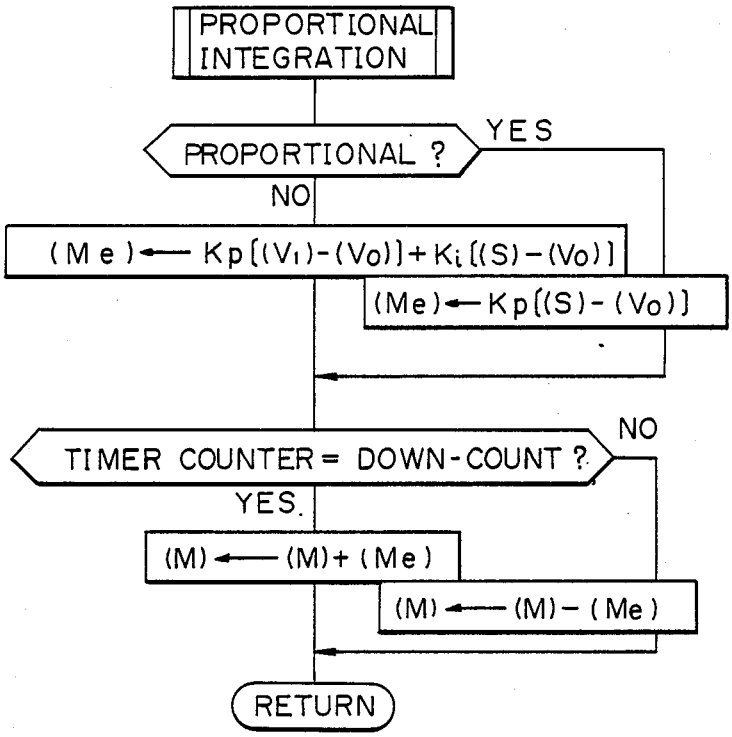
Figure 19:
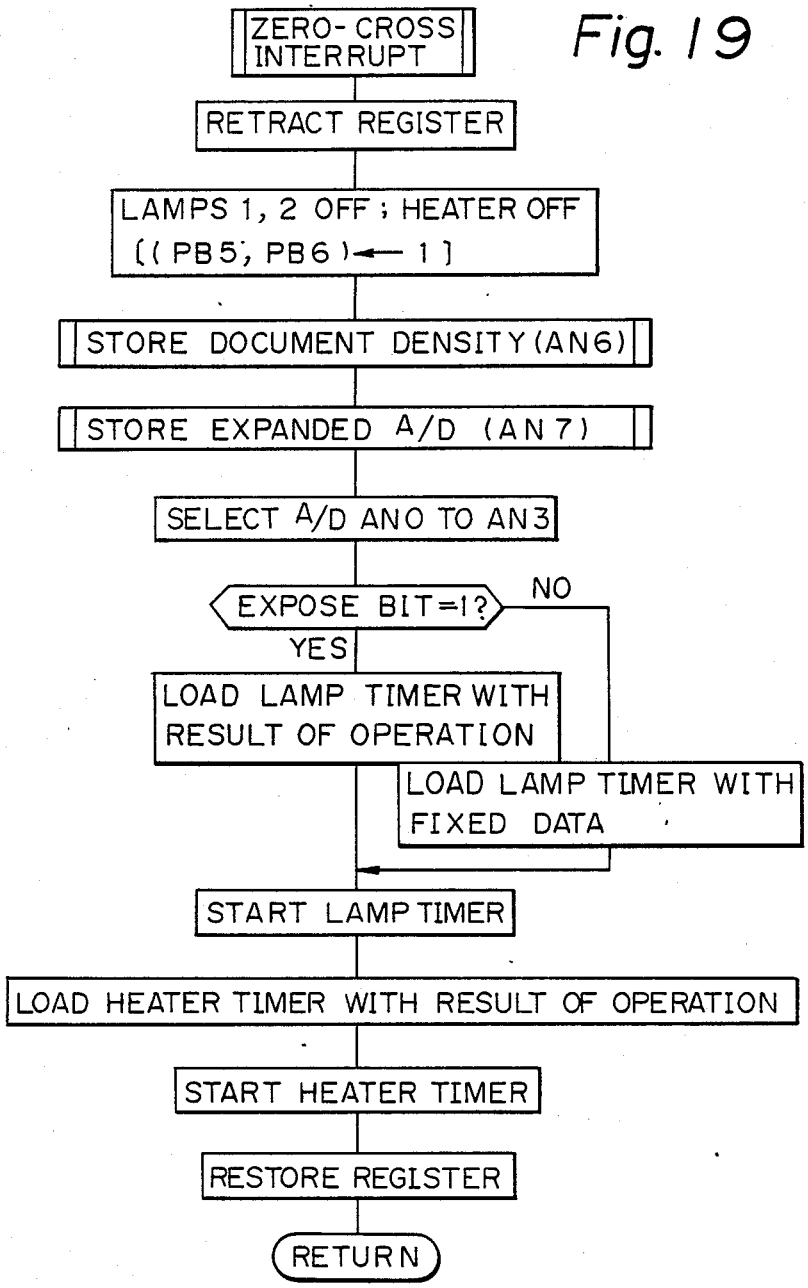
Figure 20:
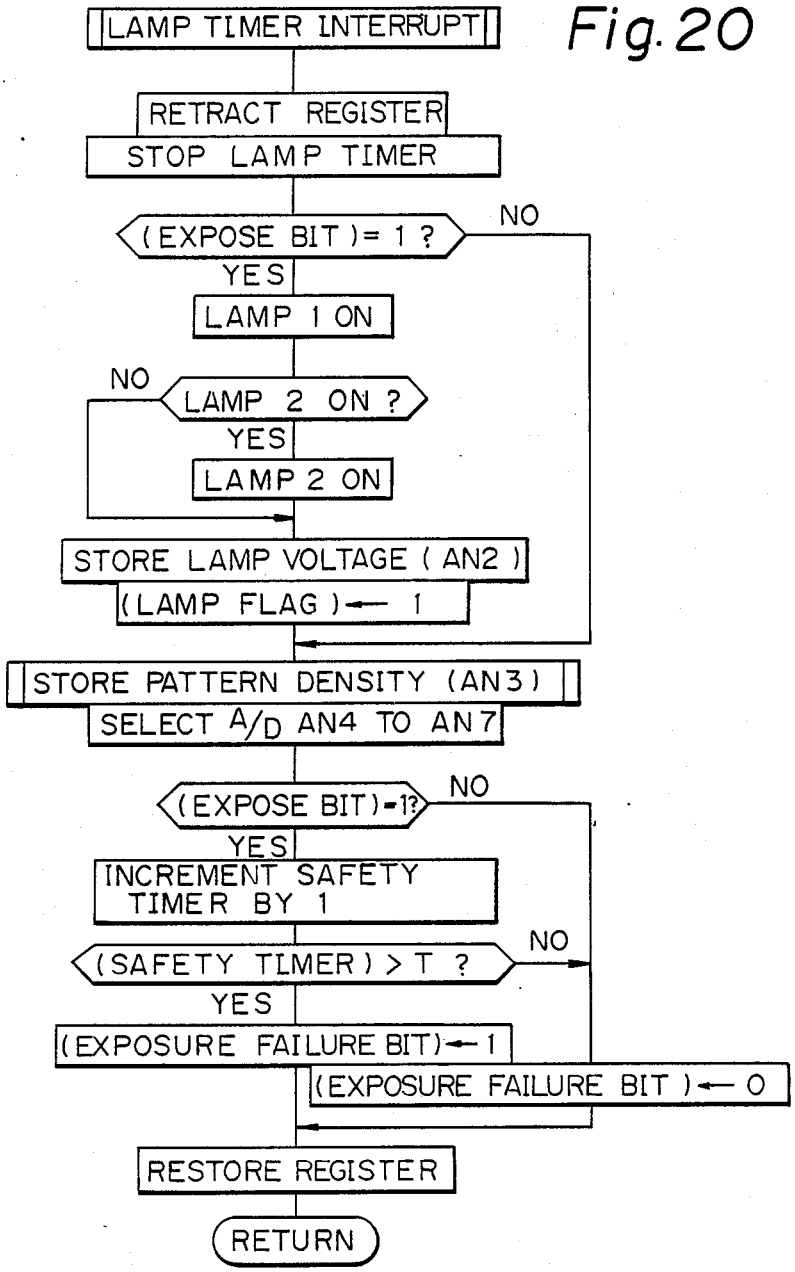
Figure 21:
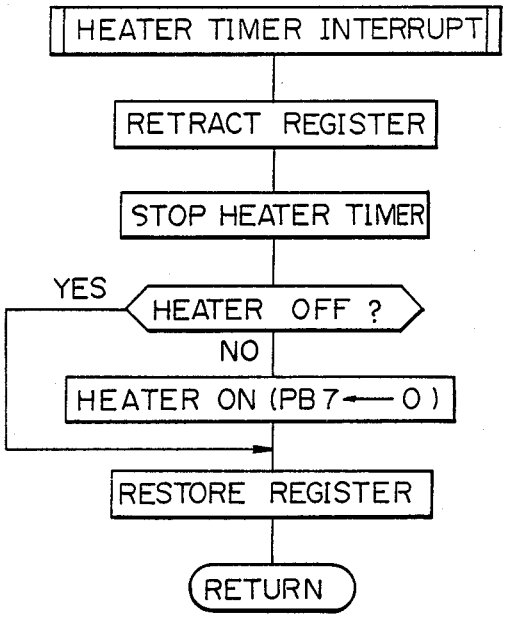
Figure 23:
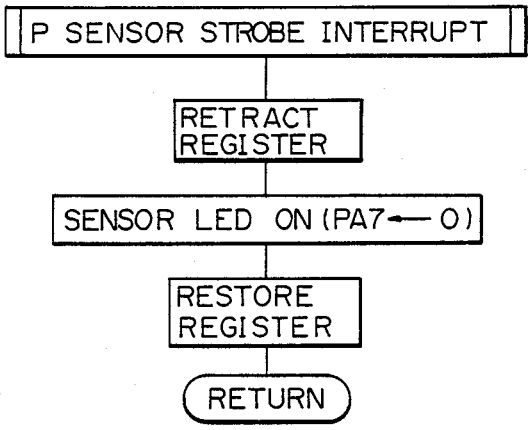
Figure 22:
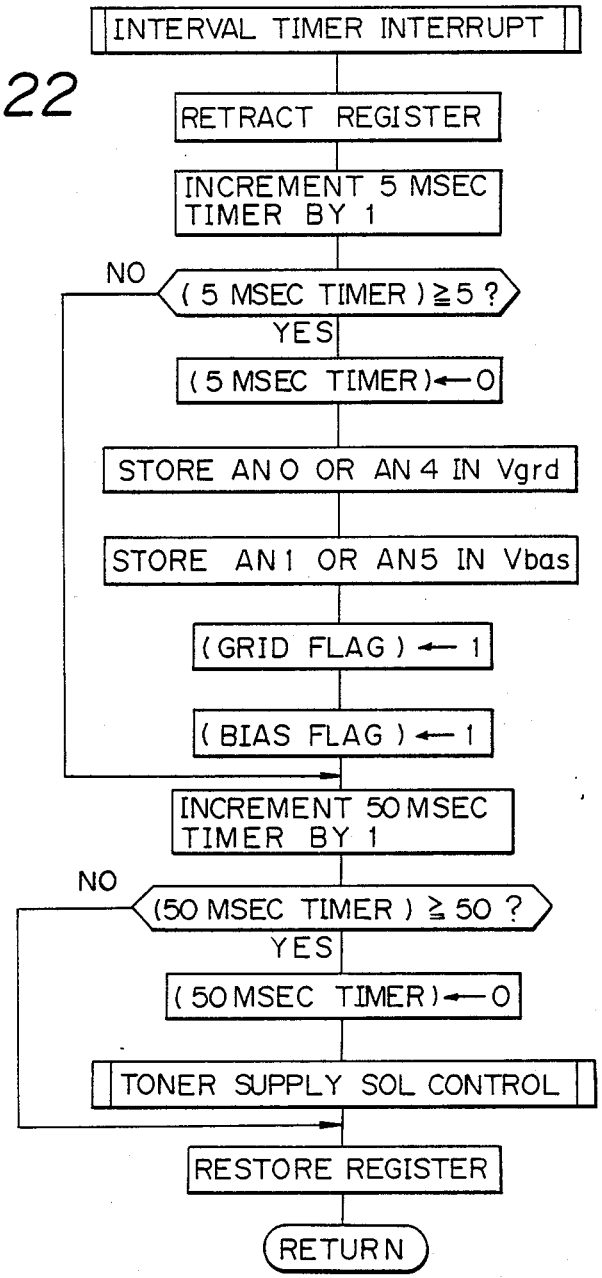

FIG. 18 shows the PROPORTIONAL INTEGRATION subroutine which is called in FIGS. 10 to 15 and FIG. 16. In FIG. 18, labeled V0, V1, S, Kp, Ki, Me and M denote data sampled this time, data sampled last time, a target value, a proportional gain, an integral gain, a variation of the amount of operation, and an amount of operation, respectively. Before calling this subroutine, the program sets the values V0, V1, S, Kp and Ki and writes the amount of operation M in a timer or a counter.

[ZERO-CROSS INTERRUPT (FIGS. 19, 26 AND 27)]

Figure 26:
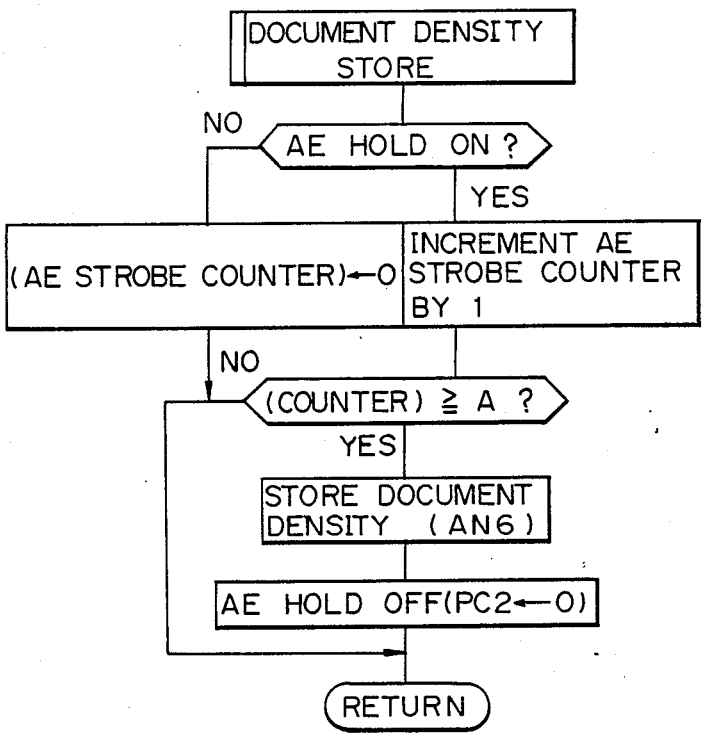
Figure 27:
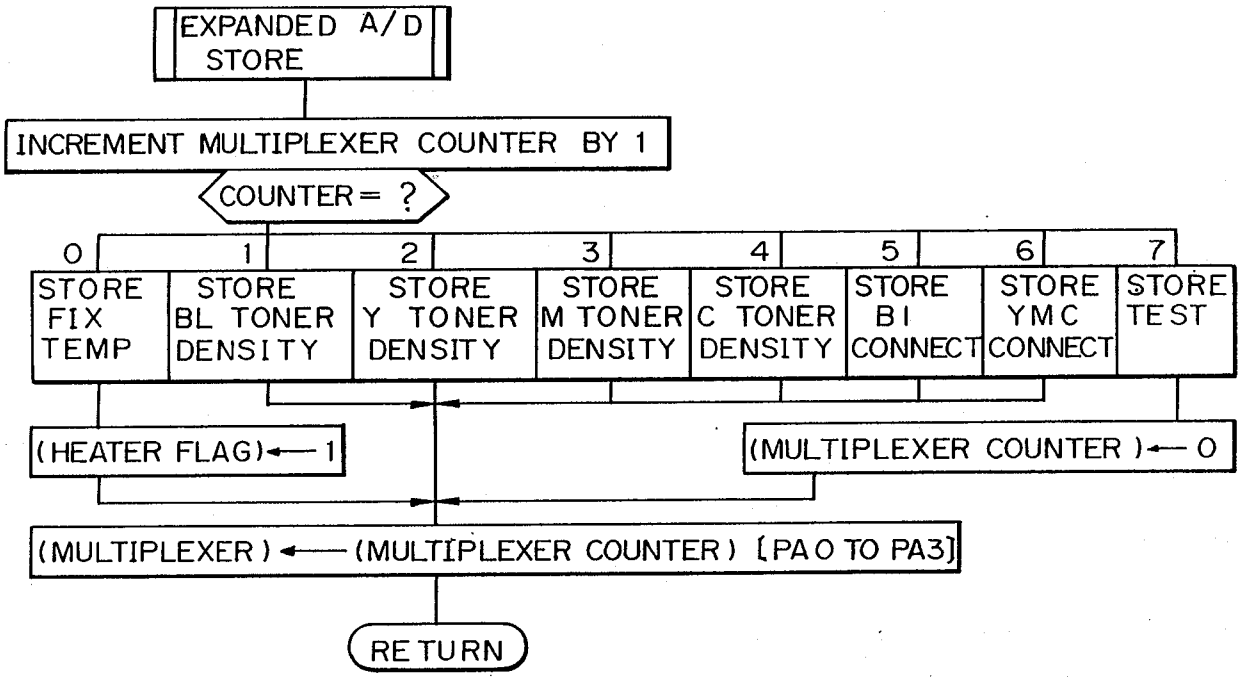
Figure 28:
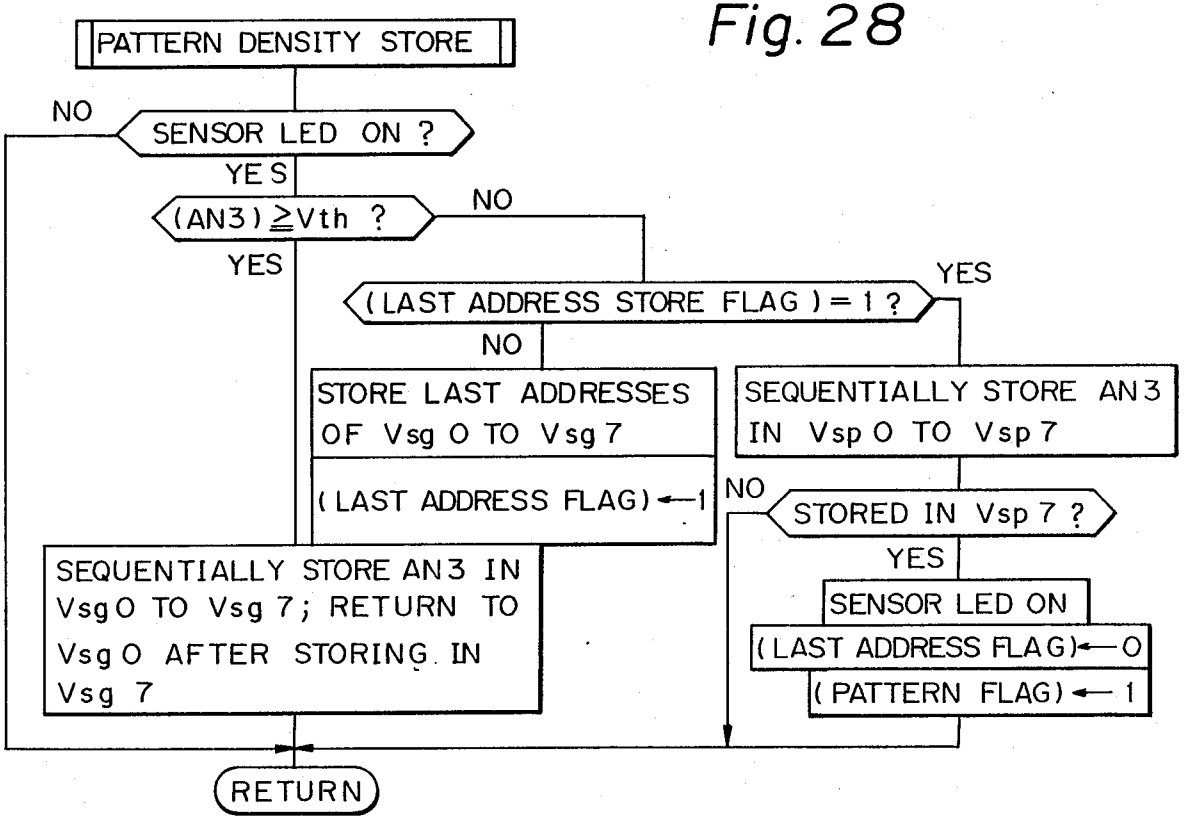

The ZERO-CROSS INTERRUPT routine begins at the positive-going edge of a zero-cross interrupt input. In this routine, a DOCUMENT DENSITY (AN6) STORE subroutine (content being shown in FIG. 26) is adapted to sample the lowest density in the background of a document, as described in relation to [Density Sampling]. As shown in FIG. 26, while AE HOLD (output of AE strobe to PC2=ON) manipulated in SERIAL RECEIVE INTERRUPT (FIG. 24) is ON, i.e., the peak hold circuit is active, the results of A/D conversion of document density (AN6) are taken in at the instant when the AE strobe counter has exceeded A (which has been set during [Frequency Detection]) and are then stored in sampling buffers of FIG. 29. In a EXPANDED A/D (AN7) STORE subroutine (the content of which is shown in FIG. 27), every time this subroutine is called by an octal multiplexer counter, the results of A/D conversion are written in sampling buffers of FIG. 9 labeled FIXING TEMPERATURE 1, 2, BL TONER DENSITY 1, 2, Y TONER DENSITY 1, 2, M TONER DENSITY 1, 2, C TONER DENSITY 1, 2, BL DEVELOPING UNIT CONNECTION, and YMC DEVELOPING UNIT CONNECTION. As for the lamp voltage, since it is constantly monitored with no regard to an "expose" bit (No. 1 of Table 1), the lamp timer is started even if EXPOSURE is a ZERO (OFF) (the lamp voltage is sampled by LAMP TIMER INTERRUPT which will be described.

[LAMP TIMER INTERRUPT (FIGS. 20, 28 AND 30)]

Figure 30:
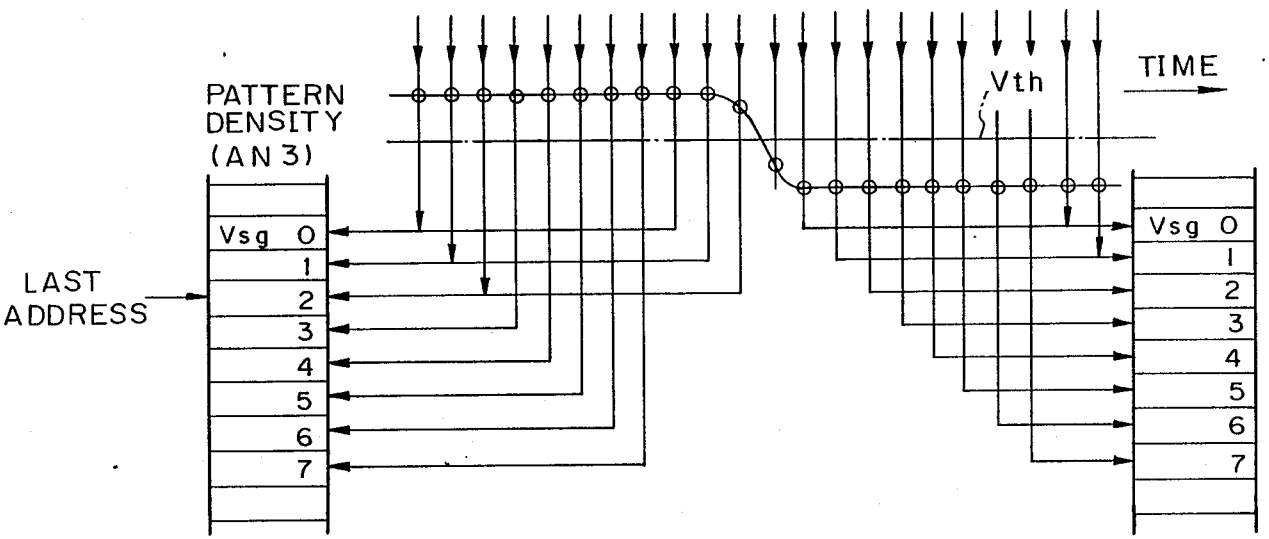
FIG. 30 is a timing chart showing the timings for the microprocessor to read pattern density and registers for storing the data read out.

The "expose" bit and a "lamp" bit (No. 1 of Table 1) are received from the main controller 60 and stored in the receive buffer. The "exposure-in-progress" bit (No. 1 of Table 4) is set or reset by LAMP CONTROL of FIG. 7A and is stored in the transmit buffer to the main controller 60. When the exposure-in-progress flag is set (bit information is a ONE) and if such a condition continues over a time of T as counted by the safety timer, an "exposure failure" bit (No. 1 Table 4) is set (bit information is turned to a ONE) and such an occurrence is transmitted to the main controller 60. PATTERN DENSITY (AN3) STORE (FIGS. 28 and 30) included in LAMP TIMER INTERRUPT is a routine for sampling the pattern density sensed by the P sensor 11 and storing the resulting data in the transmit buffer. When the LED of the P sensor 11 turned on by P SENSOR STROBE INTERRUPT (shown in FIG. 23 and described later) is ON, sampling is started. If the pattern density AN3 is higher than a threshold Vth (FIG. 30), the program regards that AN 3 is the background density and stores density value of eight points of the background in the sampling buffers Vsg0 to Vsg7. It is not that the density values are stored in the buffers Vsg0 to Vsg7 only once but that the buffers Vsg0 to Vsg7 are repetitively updated until AN3 becomes lower than the threshold Vth. As AN3 becomes lower than Vth, the last addresses of the sampling buffers Vsg0 to Vsg7 are stored and, thereafter, AN3 is sequentially stored in Vsp0 to Vsr7. When Vsp7 is filled, the LED of the P sensor 11 is deenergized and the pattern flag showing the end of sampling is set. FIG. 30 shows a relationship between the sampling timings and the registers for storing the detected values.

[HEATER TIMER INTERRUPT (FIG. 21)]

If a "heater-off" bit of the serial receiver buffer (No. 0 of Table 3) is a ZERO, the program turns on the heater 22.

[INTERVAL TIMER INTERRUPT (FIGS. 22 AND 25)]

Figures 25, 25A:
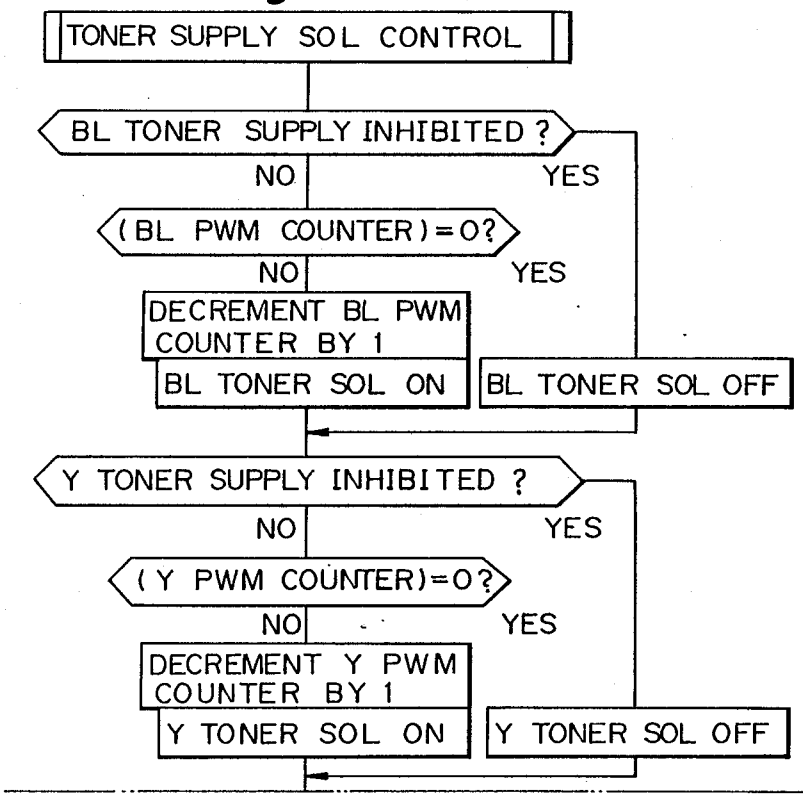
Figure 25B:
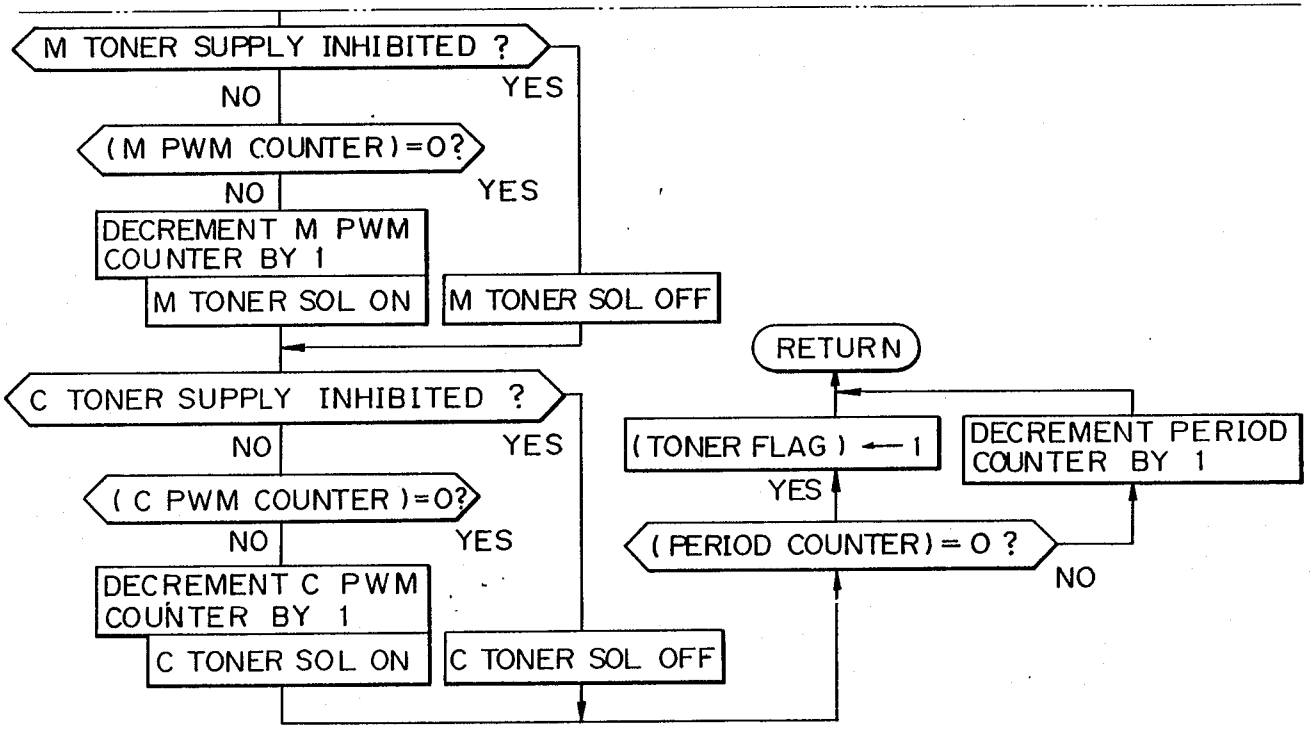

An interval timer bifunctions as the PWM period time adapted for transfer current setting. From this 1 millisecond timer, a 5 millisecond timer and a 50 millisecond timer are produced so that the grid voltage and bias voltage are sampled every 5 milliseconds and TONER SUPPLY SOL CONTROL shown in FIG. 25 is executed every 50 milliseconds.

[P SENSOR STROBE INTERRUPT (FIG. 230)]

The LED of the P sensor 11 is turned on.

[SERIAL RECEIVE INTERRUPT (FIG. 24)]

The serial receive data shown in Tables 1 to 3 are stored in the receive buffer of FIG. 29, and data (Table 4) stored in the transmit buffer of FIG. 29 are transmitted. Concerning the receive data, bit Nos. 7 and 8 are representative of an address. When the bit Nos. 7 and 8 are "00 (data representative of zero)," data is stored in OUTPUT 0 of the receive buffer and the AE strobe bit is fed to PC2; when they are "01 (data representative of 1)," data is stored in OUTPUT 1 of the receive buffer; when they are "10 (representative of 2)," the address receive flag is set and a preparation is made for the distributing the content of data (one byte) which will be received next. When data is received while the address receive flag is set, the data is distributed to 0 to 6 (Nos. 0 to 6 of Table 3) according to the previously received address data (No. 2 of Table 1). Further, when the address data is representative of 1, the data is distributed to 0 to 3 on the basis of the previously received color select data (No. 2 of Table 1 to Table 3). In this manner, the data of Tables 1 to 3 are sequentially stored in the receive buffer of FIG. 29. Since the transmit data (Table 4) are not provided with addresses, the bytes of Nos. 0 to 8 of Table 4 are repeatedly transmitted.

In the embodiment shown and described, since the grid voltage which determines the amount of charge to be deposited on the drum 1 is PWM controlled, the signal fed from the processor 71 to the grid drive circuit 3GS is a PWM controlled signal (pulse) and the grid voltage is adjusted by digital control. Hence, only a single signal line suffices. The developing bias voltage which determines recording density is also PWM controlled and, hence, the signal fed from the processor 71 to the bias drive circuit 69S is a PWM controlled signal (pulse) and the bias voltage is adjusted by digital control, so that the number of signal lines is one. Further, the transfer charge current which determines the amount of toner to be transferred from the drum 1 to a paper (recording density) is also PWM controlled so that the signal fed from the processor 71 to the transfer charge power source 16S is a PWM signal (pulse) and the transfer charge current is adjusted by digital control, requiring only one signal line. Since the exposing lamp voltage which determines the amount of light issuing from the lamp 4 is controlled with respect to phase, the signal delivered from the processor 71 to the lamp driver 4S is an ON/OFF signal (pulse) and the amount of light is adjusted by digital control and implemented by a single signal line. In addition, the heater voltage which determines the fixing temperature of the fixing roller 21 is also controlled with respect to phase, the signal fed from the processor 71 to the heater driver 22S is also an ON/OFF signal (pulse) and the fixing temperature is adjusted by digital control, needing only a single signal line.

The target values for such PWM controls and phase control are delivered from the main controller 60 to the processor 71. In response, the processor 71 reads operation levels of the various control units in the form of digital data, compare them with the target values, and adjust the energizing pulse width (in the case of PWM control) or the conduction start phase (in the case of phase control) such that the detected values coincide with the target values. Thar is, the processor 71 performs digital feedback control.

As described above, despite that the PWM controls and phase control are each implemented by a single signal line, the digital feedback control mentioned above is minute and allows delicate colors to be reproduced.

In summary, it will be seen that the present invention provides a control system for an image forming apparatus which can be implemented by a minimum number of signal lines and is immune to noise because it controls each of the variable energizing levels of various control units digitally by using a single signal line.

Various modifications will become possible for those skilled in the art after receiving the teachings of the present disclosure without departing from the scope thereof.

What is claimed is:

1. A control system for an image forming apparatus for energizing in a predetermined sequence control units for image forming including a main charger for charging a surface of a photoconductive element, an exposing light source for exposing the charged surface of said photoconductive element to imagewise light, developing means for developing an electrostatic latent image formed on the charged surface of said photoconductive element by toner, and a transfer charger for transferring a toner image to a recording medium, reading at predetermined timings output signals of sensor means including current/voltage sensing means responsive to voltages/currents of said control units, document image density sensing means, and developed image density sensing means responsive to toner density in a predetermined area on said drum outside of a recording medium transfer area, and adjusting the voltages or currents of said control units in response to the output signals of said sensor means, said system comprising:

main control means for producing signals for commanding energization/deenergization of said control units in a predetermined sequence, producing digital signals representative of target values for energizing said control units, and transmitting the signals for commanding energization/deenergization and digital signals representative of the target values; and process control means for receiving the signals commanding energization/deenergization which are sent from said main control means and energizing/deenergizing said control units based on the signals, receiving the digital signals representative of the target values from said main control means, converting the output signals of said sensor means, and setting voltages/currents for energizing said control units on the basis of the digital signals representative of the target values and the digital signals associated with the output signals of said sensor means.

2. A system as claimed in claim 1, wherein said process control means sets a transfer charger current by a PWM (Pulse Width Modulation) control and transmits the digital signals representative of the output signals of said sensors to said main control means.

* * * * *